US011738232B2

(12) United States Patent
Moore

(10) Patent No.: US 11,738,232 B2
(45) Date of Patent: Aug. 29, 2023

(54) ONEBAND RESISTANCE EXERCISE SYSTEM

(71) Applicant: Cory Eugene Moore, Upper Marlboro, MD (US)

(72) Inventor: Cory Eugene Moore, Upper Marlboro, MD (US)

( * ) Notice: Subject to any disclaimer, the term of this patent is extended or adjusted under 35 U.S.C. 154(b) by 0 days.

(21) Appl. No.: 15/932,796

(22) Filed: Apr. 27, 2018

(65) Prior Publication Data

US 2019/0060696 A1 Feb. 28, 2019

Related U.S. Application Data

(60) Provisional application No. 62/602,568, filed on Apr. 28, 2017.

(51) Int. Cl.

| | |
|---|---|
| ***A63B 21/055*** | (2006.01) |
| ***A63B 24/00*** | (2006.01) |
| ***A63B 71/06*** | (2006.01) |
| ***A63B 21/00*** | (2006.01) |
| ***A63B 21/04*** | (2006.01) |
| ***A63B 23/035*** | (2006.01) |
| ***A63B 23/04*** | (2006.01) |
| ***A63B 23/12*** | (2006.01) |
| ***A63B 23/00*** | (2006.01) |

(52) U.S. Cl.

CPC .... *A63B 21/0555* (2013.01); *A63B 21/00069* (2013.01); *A63B 21/00185* (2013.01); *A63B 21/0428* (2013.01); *A63B 21/0442* (2013.01); *A63B 21/0557* (2013.01); *A63B 21/4025* (2015.10); *A63B 23/03541* (2013.01); *A63B 23/0488* (2013.01); *A63B 23/1281* (2013.01); *A63B 24/0062* (2013.01); *A63B 71/0622* (2013.01); *A63B 23/1236* (2013.01); *A63B 2023/006* (2013.01); *A63B 2071/0663* (2013.01); *A63B 2209/10* (2013.01); *A63B 2220/51* (2013.01); *A63B 2220/833* (2013.01); *A63B 2225/50* (2013.01)

(58) Field of Classification Search

CPC .. A63B 21/055–0557; A63B 21/00069; A63B 2220/51; A63B 2220/833

See application file for complete search history.

(56) References Cited

U.S. PATENT DOCUMENTS

| | | | | |
|---|---|---|---|---|
| 5,538,486 A * | 7/1996 | France | A63B 21/0552 482/8 |
| 6,026,548 A * | 2/2000 | Jackson | A43C 7/08 24/115 G |
| 8,870,722 B2 | 10/2014 | Kassel | |
| 2007/0213186 A1 * | 9/2007 | Longo | A63B 21/169 482/121 |

(Continued)

*Primary Examiner* — Jennifer Robertson

(74) *Attorney, Agent, or Firm* — John Leonard Young

(57) ABSTRACT

A method of use and system of an adjustable, multiple routine, resistance exercise, apparatus having a single, continuous length of elastic flexible and/or stretchable tubing, banding, and/or strapping, formed in a continuous loop, by having the two free ends of the length of tubing, banding, and/or strapping knotted securely together, thus forming a continuous loop exercise device, having at least three scalable calibrated sections demarcated by a plurality of knotted sections, forming a chain of loops with knotted stays strategically spaced along the length of the formed continuous loop device.

13 Claims, 35 Drawing Sheets

(56) References Cited

U.S. PATENT DOCUMENTS

| | | | | |
|---|---|---|---|---|
| 2008/0139369 | A1* | 6/2008 | Vigilia | A63B 21/4009 482/124 |
| 2010/0037380 | A1 | 2/2010 | Robbins | |
| 2012/0202662 | A1* | 8/2012 | DeMarco | A63B 23/1236 482/143 |
| 2014/0283339 | A1* | 9/2014 | Gallagher | F16G 11/046 24/115 K |
| 2014/0323271 | A1* | 10/2014 | Hinds | A63B 21/0442 482/8 |
| 2016/0310777 | A1* | 10/2016 | Crowell | A63B 21/0555 |

* cited by examiner

| | | | | | Modulus | 10% | 20% | 30% | 40% |
|---|---|---|---|---|---|---|---|---|---|
| | | | | | psi | 46.5 | 51.1 | 56.1 | 61.6 |
| Latex Dipped Natural Rubber |  Black Tube | Outside Diameter, Inches | Inside Diameter, Inches | Cross Sectional Area, square inches | Pounds Force at Break | 10% modulus, lbs. Force | 20% modulus, lbs. Force | 30% modulus, lbs. Force | 40% modulus, lbs. Force |
| Tensile Strength, psi | 4894 | 0.50 | 0.063 | 0.193 | 945.9 | 9.0 | 9.9 | 10.8 | 11.9 |
| Elongation, % | 785 | 0.50 | 0.125 | 0.184 | 900.9 | 8.6 | 9.4 | 10.3 | 11.3 |
| 100% modulus, psi | 121 | 0.50 | 0.250 | 0.147 | 720.7 | 6.9 | 7.5 | 8.3 | 9.1 |
| 200% modulus, psi | 219 | 0.25 | 0.125 | 0.037 | 180.2 | 1.7 | 1.9 | 2.1 | 2.3 |
| 300% modulus, psi | 785 | | | | | | | | |

| | | | | | Modulus | 50% | 60% | 70% | 80% |
|---|---|---|---|---|---|---|---|---|---|
| | | | | | psi | 67.7 | 74.3 | 81.6 | 89.6 |
| Latex Dipped Natural Rubber | Black Tube | Outside Diameter, Inches | Inside Diameter, Inches | Cross Sectional Area, square inches | **Pounds Force at Break** | 50% modulus, lbs. Force | 60% modulus, lbs. Force | 70% modulus, lbs. Force | 80% modulus, lbs. Force |
| Tensile Strength, psi | 4894 | 0.50 | 0.063 | 0.193 | **945.9** | 13.1 | 14.4 | 15.8 | 17.3 |
| Elongation, % | 785 | 0.50 | 0.125 | 0.184 | **900.9** | 12.5 | 13.7 | 15.0 | 16.5 |
| 100% modulus, psi | 121 | 0.50 | 0.250 | 0.147 | **720.7** | 10.0 | 10.9 | 12.0 | 13.2 |
| 200% modulus, psi | 219 | 0.25 | 0.125 | 0.037 | **180.2** | 2.5 | 2.7 | 3.0 | 3.3 |
| 300% modulus, psi | 785 | | | | | | | | |

FIG. 14B

| | | | | | Modulus | 90% | 100% | 110% | 120% |
|---|---|---|---|---|---|---|---|---|---|
| | | | | | psi | 98.3 | 108.0 | 118.6 | 130.2 |
| Latex Dipped Natural Rubber | Black Tube | Outside Diameter, Inches | Inside Diameter, Inches | Cross Sectional Area, square inches | **Pounds Force at Break** | 90% modulus, lbs. Force | 100% modulus, lbs. Force | 110% modulus, lbs. Force | 120% modulus, lbs. Force |
| Tensile Strength, psi | 4894 | 0.50 | 0.063 | 0.193 | **945.9** | 19.0 | 20.9 | 22.9 | 25.2 |
| Elongation, % | 785 | 0.50 | 0.125 | 0.184 | **900.9** | 18.1 | 19.9 | 21.8 | 24.0 |
| 100% modulus, psi | 121 | 0.50 | 0.250 | 0.147 | **720.7** | 14.5 | 15.9 | 17.5 | 19.2 |
| 200% modulus, psi | 219 | 0.25 | 0.125 | 0.037 | **180.2** | 3.6 | 4.0 | 4.4 | 4.8 |
| 300% modulus, psi | 785 | | | | | | | | |

FIG. 14C

| | | | | | Modulus | 130% | 140% | 150% | 160% |
|---|---|---|---|---|---|---|---|---|---|
| | | | | | psi | 142.9 | 156.9 | 172.3 | 189.2 |
| Latex Dipped Natural Rubber |  Black Tube | Outside Diameter, Inches | Inside Diameter, Inches | Cross Sectional Area, square inches | Pounds Force at Break | 130% modulus, lbs. Force | 140% modulus, lbs. Force | 150% modulus, lbs. Force | 160% modulus, lbs. Force |
| Tensile Strength, psi | 4894 | 0.50 | 0.063 | 0.193 | 945.9 | 27.6 | 30.3 | 33.3 | 36.6 |
| Elongation, % | 785 | 0.50 | 0.125 | 0.184 | 900.9 | 26.3 | 28.9 | 31.7 | 34.8 |
| 100% modulus, psi | 121 | 0.50 | 0.250 | 0.147 | 720.7 | 21.0 | 23.1 | 25.4 | 27.9 |
| 200% modulus, psi | 219 | 0.25 | 0.125 | 0.037 | 180.2 | 5.3 | 5.8 | 6.3 | 7.0 |
| 300% modulus, psi | 785 | | | | | | | | |

| | | | | | Modulus | 170% | 180% | 190% | 200% |
|---|---|---|---|---|---|---|---|---|---|
| | | | | | psi | 207.7 | 228.1 | 250.5 | 275.0 |
| Latex Dipped Natural Rubber |  Black Tube | Outside Diameter, Inches | Inside Diameter, Inches | Cross Sectional Area, square inches | Pounds Force at Break | 170% modulus, lbs. Force | 180% modulus, lbs. Force | 190% modulus, lbs. Force | 200% modulus, lbs. Force |
| Tensile Strength, psi | 4894 | 0.50 | 0.063 | 0.193 | 945.9 | 40.2 | 44.1 | 48.4 | 53.2 |
| Elongation, % | 785 | 0.50 | 0.125 | 0.184 | 900.9 | 38.2 | 42.0 | 46.1 | 50.6 |
| 100% modulus, psi | 121 | 0.50 | 0.250 | 0.147 | 720.7 | 30.6 | 33.6 | 36.9 | 40.5 |
| 200% modulus, psi | 219 | 0.25 | 0.125 | 0.037 | 180.2 | 7.6 | 8.4 | 9.2 | 10.1 |
| 300% modulus, psi | 785 | | | | | | | | |

| | | | | | Modulus | 10% | 20% | 30% | 40% |
|---|---|---|---|---|---|---|---|---|---|
| | | | | | psi | 46.5 | 51.1 | 56.1 | 61.6 |
| Latex Dipped Natural Rubber | [redacted] Black Rectangle Band | Width, Inches | Height, Inches | Cross Sectional Area, square inches | **Pounds Force at Break** | 10% modulus lbs. Force | 20% modulus lbs. Force | 30% modulus lbs. Force | 40% modulus lbs. Force |
| Tensile Strength, psi | 4884 | 1.50 | 0.250 | 0.375 | **1835.3** | 17.5 | 19.2 | 21.0 | 23.1 |
| Elongation, % | 785 | 1.50 | 0.125 | 0.188 | **917.6** | 8.7 | 9.6 | 10.5 | 11.6 |
| 100% modulus, psi | 121 | 1.00 | 0.375 | 0.375 | **1835.3** | 17.5 | 19.2 | 21.0 | 23.1 |
| 200% modulus, psi | 219 | 1.00 | 0.125 | 0.125 | **611.8** | 5.8 | 6.4 | 7.0 | 7.7 |
| 300% modulus, psi | 785 | | | | | | | | |

FIG. 14G

| | | | | | Modulus | 50% | 60% | 70% | 80% |
|---|---|---|---|---|---|---|---|---|---|
| | | | | | psi | 67.7 | 74.3 | 81.6 | 89.6 |
| Latex Dipped Natural Rubber | [redacted] Black Rectangle Band | Width, Inches | Height, Inches | Cross Sectional Area, square inches | **Pounds Force at Break** | 50% modulus lbs. Force | 60% modulus lbs. Force | 70% modulus lbs. Force | 80% modulus lbs. Force |
| Tensile Strength, psi | 4894 | 1.50 | 0.250 | 0.375 | **1835.3** | 25.4 | 27.9 | 30.6 | 33.6 |
| Elongation, % | 785 | 1.50 | 0.125 | 0.188 | **917.6** | 12.7 | 13.9 | 15.3 | 16.8 |
| 100% modulus, psi | 121 | 1.00 | 0.375 | 0.375 | **1835.3** | 25.4 | 27.9 | 30.6 | 33.6 |
| 200% modulus, psi | 219 | 1.00 | 0.125 | 0.125 | **611.8** | 8.5 | 9.3 | 10.2 | 11.2 |
| 300% modulus, psi | 785 | | | | | | | | |

FIG. 14H

| | | | | | Modulus | 90% | 100% | 110% | 120% |
|---|---|---|---|---|---|---|---|---|---|
| | | | | | psi | 98.3 | 108.0 | 118.6 | 130.2 |
| Latex Dipped Natural Rubber | [redacted] Black Rectangle Band | Width, Inches | Height, Inches | Cross Sectional Area, square inches | **Pounds Force at Break** | 90% modulus lbs. Force | 100% modulus lbs. Force | 110% modulus lbs. Force | 120% modulus lbs. Force |
| Tensile Strength, psi | 4894 | 1.50 | 0.250 | 0.375 | **1835.3** | 36.9 | 40.5 | 44.5 | 48.8 |
| Elongation, % | 785 | 1.50 | 0.125 | 0.188 | **917.6** | 18.4 | 20.2 | 22.2 | 24.4 |
| 100% modulus, psi | 121 | 1.00 | 0.375 | 0.375 | **1835.3** | 36.9 | 40.5 | 44.5 | 48.8 |
| 200% modulus, psi | 219 | 1.00 | 0.125 | 0.125 | **611.8** | 12.3 | 13.5 | 14.8 | 16.3 |
| 300% modulus, psi | 785 | | | | | | | | |

FIG. 14I

| | | | | | Modulus | 130% | 140% | 150% | 160% |
|---|---|---|---|---|---|---|---|---|---|
| | | | | | psi | 142.9 | 156.9 | 172.3 | 189.2 |
| Latex Dipped Natural Rubber | [redacted] Black Rectangle Band | Width, Inches | Height, Inches | Cross Sectional Area, square inches | **Pounds Force at Break** | 130% modulus, lbs. Force | 140% modulus, lbs. Force | 150% modulus, lbs. Force | 160% modulus, lbs. Force |
| Tensile Strength, psi | 4894 | 1.50 | 0.250 | 0.375 | **1835.3** | 53.6 | 58.8 | 64.6 | 70.9 |
| Elongation, % | 785 | 1.50 | 0.125 | 0.188 | **917.6** | 26.8 | 29.4 | 32.3 | 35.5 |
| 100% modulus, psi | 121 | 1.00 | 0.375 | 0.375 | **1835.3** | 53.6 | 58.8 | 64.6 | 70.9 |
| 200% modulus, psi | 219 | 1.00 | 0.125 | 0.125 | **611.8** | 17.9 | 19.6 | 21.5 | 23.6 |
| 300% modulus, psi | 785 | | | | | | | | |

FIG. 14J

| | | | | | Modulus | 170% | 180% | 190% | 200% |
|---|---|---|---|---|---|---|---|---|---|
| | | | | | psi | 207.7 | 228.1 | 250.5 | 275.0 |
| Latex Dipped Natural Rubber | [redacted] Black Rectangle Band | Width, Inches | Height, Inches | Cross Sectional Area, square inches | **Pounds Force at Break** | 170% modulus, lbs. Force | 180% modulus, lbs. Force | 190% modulus, lbs. Force | 200% modulus, lbs. Force |
| Tensile Strength, psi | 4894 | 1.50 | 0.250 | 0.375 | **1835.3** | 77.9 | 85.5 | 93.9 | 103.1 |
| Elongation, % | 785 | 1.50 | 0.125 | 0.188 | **917.6** | 39.0 | 42.8 | 47.0 | 51.6 |
| 100% modulus, psi | 121 | 1.00 | 0.375 | 0.375 | **1835.3** | 77.9 | 85.5 | 93.9 | 103.1 |
| 200% modulus, psi | 219 | 1.00 | 0.125 | 0.125 | **611.8** | 26.0 | 28.5 | 31.3 | 34.4 |
| 300% modulus, psi | 785 | | | | | | | | |

FIG. 14K

FIG. 15A

| | | | | | Modulus | 10% | 20% | 30% | 40% |
|---|---|---|---|---|---|---|---|---|---|
| | | | | | psi | 65.8 | 69.6 | 73.5 | 77.7 |
| High Elongation EPDM | EPDM | Outside Diameter, Inches | Inside Diameter, Inches | Cross Sectional Area, square inches | **Pounds Force at Break** | 10% modulus, lbs. Force | 20% modulus, lbs. Force | 30% modulus, lbs. Force | 40% modulus, lbs. Force |
| Durometer A, points | 35 | 0.50 | 0.063 | 0.193 | **392.9** | 12.7 | 13.4 | 14.2 | 15.0 |
| Tensile Strength, psi | 2033 | 0.50 | 0.125 | 0.184 | **374.2** | 12.1 | 12.8 | 13.5 | 14.3 |
| Ultimate Elongation, % | 917 | 0.50 | 0.250 | 0.147 | **299.4** | 9.7 | 10.2 | 10.8 | 11.4 |
| 100% Modulus, psi | 106 | 0.25 | 0.125 | 0.037 | **74.8** | 2.4 | 2.6 | 2.7 | 2.9 |

| | | | | | Modulus | 50% | 60% | 70% | 80% |
|---|---|---|---|---|---|---|---|---|---|
| | | | | | psi | 82.1 | 86.8 | 91.8 | 97.0 |
| High Elongation EPDM | EPDM | Outside Diameter, Inches | Inside Diameter, Inches | Cross Sectional Area, square inches | **Pounds Force at Break** | 50% modulus, lbs. Force | 60% modulus, lbs. Force | 70% modulus, lbs. Force | 80% modulus, lbs. Force |
| Durometer A, points | 35 | 0.50 | 0.063 | 0.193 | **392.9** | 15.9 | 16.8 | 17.7 | 18.7 |
| Tensile Strength, psi | 2033 | 0.50 | 0.125 | 0.184 | **374.2** | 15.1 | 16.0 | 16.9 | 17.9 |
| Ultimate Elongation, % | 917 | 0.50 | 0.250 | 0.147 | **299.4** | 12.1 | 12.8 | 13.5 | 14.3 |
| 100% Modulus, psi | 106 | 0.25 | 0.125 | 0.037 | **74.8** | 3.0 | 3.2 | 3.4 | 3.6 |

FIG. 15B

| | | | | Modulus | 90% | 100% |
|---|---|---|---|---|---|---|
| | | | | psi | 102.5 | 108.3 |
| High Elongation EPDM | Outside Diameter, Inches | Inside Diameter, Inches | Cross Sectional Area, square inches | **Pounds Force at Break** | 90% modulus, lbs. Force | 100% modulus, lbs. Force |
| Durometer A, points | 0.50 | 0.063 | 0.193 | **392.9** | 19.8 | 20.9 |
| Tensile Strength, psi | 0.50 | 0.125 | 0.184 | **374.2** | 18.9 | 19.9 |
| Ultimate Elongation, % | 0.50 | 0.250 | 0.147 | **299.4** | 15.1 | 16.0 |
| 100% Modulus, psi | 0.25 | 0.125 | 0.037 | **74.8** | 3.8 | 4.0 |

FIG. 15E

| | | | | | Modulus | 10% | 20% | 30% | 40% | 50% |
|---|---|---|---|---|---|---|---|---|---|---|
| | | | | | psi | 134.4 | 141.4 | 148.9 | 156.7 | 165.0 |
| EPDM Compound | EPDM | Outside Diameter, Inches | Inside Diameter, Inches | Cross Sectional Area, square inches | **Pounds Force at Break** | 10% modulus, lbs. Force | 20% modulus, lbs. Force | 30% modulus, lbs. Force | 40% modulus, lbs. Force | 50% modulus, lbs. Force |
| Durometer, points | 55 | 0.50 | 0.063 | 0.193 | **444.5** | 26.0 | 27.3 | 28.8 | 30.3 | 31.9 |
| Tensile Strength, psi | 2300 | 0.50 | 0.125 | 0.184 | **423.4** | 24.7 | 26.0 | 27.4 | 28.8 | 30.4 |
| Ultimate Elongation, % | 650 | 0.50 | 0.250 | 0.147 | **338.7** | 19.8 | 20.8 | 21.9 | 23.1 | 24.3 |
| 50% Modulus, psi | 178 | 0.25 | 0.125 | 0.037 | **84.7** | 4.9 | 5.2 | 5.5 | 5.8 | 6.1 |

| | | | | | Modulus | 10% | 20% | 30% | 40% | 50% |
|---|---|---|---|---|---|---|---|---|---|---|
| | | | | | psi | 134.4 | 141.4 | 148.9 | 156.7 | 165.0 |
| EPDM Compound | EPDM | Outside Diameter, Inches | Inside Diameter, Inches | Cross Sectional Area, square inches | **Pounds Force at Break** | 10% modulus, lbs. Force | 20% modulus, lbs. Force | 30% modulus, lbs. Force | 40% modulus, lbs. Force | 50% modulus, lbs. Force |
| Durometer, points | 55 | 1.50 | 0.250 | 0.375 | **862.5** | 50.4 | 53.0 | 55.8 | 58.8 | 61.9 |
| Tensile Strength, psi | 2300 | 1.50 | 0.125 | 0.188 | **431.3** | 25.2 | 26.5 | 27.9 | 29.4 | 30.9 |
| Ultimate Elongation, % | 650 | 1.00 | 0.375 | 0.375 | **862.5** | 50.4 | 53.0 | 55.8 | 58.8 | 61.9 |
| 50% Modulus, psi | 178 | 1.00 | 0.125 | 0.125 | **287.5** | 16.8 | 17.7 | 18.6 | 19.6 | 20.6 |

FIG. 15F

| | | | | | | | Modulus | 10% | 20% |
|---|---|---|---|---|---|---|---|---|---|
| | | | | | | | psi | 69.3 | 75.5 |
| Natural Rubber Compound | Natural Rubber | Outside Diameter Inches | area outer circle | Inside Diameter Inches | area inner circle | Cross Sectional Area, square inches | **Pounds Force at Break** | 10% modulus, lbs. Force | 20% modulus, lbs. Force |
| **Property** | **#6** | 0.50 | 0.196 | 0.063 | 0.003 | 0.193 | **754.8** | 13.39 | 14.59 |
| Durometer | 45 | 0.50 | 0.196 | 0.125 | 0.012 | 0.184 | **718.8** | 12.75 | 13.89 |
| Tensile Strength psi | 3905 | 0.50 | 0.196 | 0.250 | 0.049 | 0.147 | **575.1** | 10.20 | 11.11 |
| Ultimate Elongation,% | 672 | 0.25 | 0.049 | 0.125 | 0.012 | 0.037 | **143.8** | 2.55 | 2.78 |
| 10% Modulus, psi | 53 | | | | | | | | |
| 20% Modulus, psi | 71 | | | | | | | | |

FIG. 16A

| | | | | | | | Modulus | 100% | 200% |
|---|---|---|---|---|---|---|---|---|---|
| | | | | | | | psi | 150.0 | 353.8 |
| Natural Rubber Compound | Natural Rubber | Outside Diameter Inches | area outer circle | Inside Diameter Inches | area inner circle | Cross Sectional Area, square inches | **Pounds Force at Break** | 100% modulus, lbs. Force | 200% modulus, lbs. Force |
| **Property** | **#6** | 0.50 | 0.196 | 0.063 | 0.003 | 0.193 | **754.8** | 28.98 | 63.38 |
| Durometer | 45 | 0.50 | 0.196 | 0.125 | 0.012 | 0.184 | **718.8** | 27.60 | 65.12 |
| Tensile Strength psi | 3905 | 0.50 | 0.196 | 0.250 | 0.049 | 0.147 | **575.1** | 22.08 | 52.10 |
| Ultimate Elongation,% | 672 | 0.25 | 0.049 | 0.125 | 0.012 | 0.037 | **143.8** | 5.52 | 13.02 |
| 10% Modulus, psi | 53 | | | | | | | | |
| 20% Modulus, psi | 71 | | | | | | | | |

FIG. 16B

| | | | | | Modulus | 10% | 20% | 100% | 200% |
|---|---|---|---|---|---|---|---|---|---|
| | | | | | psi | 69.3 | 75.5 | 150.0 | 353.8 |
| Natural Rubber Compound | Natural Rubber | Outside Diameter, Inches | Inside Diameter, Inches | Cross Sectional Area, square inches | **Pounds Force at Break** | 10% modulus, lbs. Force | 20% modulus, lbs. Force | 100% modulus, lbs. Force | 200% modulus, lbs. Force |
| **Property** | **#6** | 1.50 | 0.250 | 0.375 | **1464.4** | 25.97 | 28.30 | 56.23 | 132.66 |
| Durometer | 45 | 1.50 | 0.125 | 0.188 | **732.2** | 12.99 | 14.15 | 28.12 | 66.33 |
| Tensile Strength psi | 3905 | 1.00 | 0.375 | 0.375 | **1464.4** | 25.97 | 28.30 | 56.23 | 132.66 |
| Ultimate Elongation,% | 672 | 1.00 | 0.125 | 0.125 | **488.1** | 8.66 | 9.43 | 18.74 | 44.22 |
| 10% Modulus, psi | 53 | | | | | | | | |
| 20% Modulus, psi | 71 | | | | | | | | |
| 30% Modulus, psi | 85 | | | | | | | | |
| 40% Modulus, psi | 98 | | | | | | | | |
| 50% Modulus, psi | 110 | | | | | | | | |
| 100% Modulus, psi | 171 | | | | | | | | |
| 200% Modulus, psi | 377 | | | | | | | | |

FIG. 16C

ONEBAND RESISTANCE EXERCISE SYSTEM

RELATED APPLICATIONS

This U.S. Patent Application is related to Provisional Application for U.S. Patent No. 62/602,568 Rope-A-Dope Resistance Exercise System (hereinafter referred to as OneBand and/or referred to as OneBand Resistance Training System, and/or referred to as OneBand Resistance Exercise System, as-well-as referred to as Rope-A-Dope Resistance Exercise System), filed on Apr. 28, 2017, having the same inventor as the instant application and incorporated by reference herein in its entirety; furthermore, the Applicant claims the benefit of domestic priority of the above listed Provisional Application for U.S. Patent.

FIELD OF THE INVENTION

The present invention relates to exercise devices. More specifically, the invention relates to a resistance exercise system and is an improvement over known conventional resistance exercise devices.

BACKGROUND OF THE INVENTION

Conventional, resistance exercise devices are composed of rubber stretchable resistance tubes, elastic exercise straps, solid rubber stretch bands as well as flexible, woven strands of stretchable rubber and other elastic composite materials. These resistance exercise devices include coupling attachments, comprising loops, buckles, rings (such as O-rings), clamps including adjustable-clamp mechanisms, handles and/or snaps or other rigid connectable attachments such as metal or rigid plastics, course canvas straps including VELCRO®, rubber or foam.

A conventional, related art, resistance, exercise device is disclosed in U.S. Pat. No. 9,468,789 to Williams (referring to FIG. 3) having a rigid plastic "mounting block" (40) connecting device, in association with a resistance band, where "Mounting block 40 generally comprises a rigid or semi rigid material" (see Williams column 5, lines 19-21).

Another conventional, related art, resistance, exercise device is disclosed in U.S. Pat. No. 8,870,722 to Kassel (referring to at least FIG. 1, FIG. 5, FIG. 6, FIG. 9, FIG. 17, FIG. 18, FIG. 21A, FIG. 21B, and FIG. 21C) including an assortment of connector devices, such as plastic or metal "carabineer for providing multiple exercise options . . . [including] handles, loops, straps, bands, rings, rope, grips" (see Kassel, column 6, lines 51-56).

An additional related art, resistance, exercise device, U.S. Pat. No. 9,248,331 to Collier, et al., discusses a resistance band exercise device having markings, where (referring to FIG. 2, FIG. 3, FIG. 4 FIG. 4C, FIG. 4D, FIG. 4E, and FIG. 4F) "the markings on the resistance band correspond to the amount of free weights that a user would be lifting" (see Collier, column 2, lines 50-55).

In another related art, resistance, exercise device, U.S. Pat. No. 7,344,485, to Simpson et al., which (referring to FIG. 1) discloses a "resistance-type exercise apparatus adaptable for a variety of body exercises . . . [it] includes a length of resilient tubing having first and second free ends. Strap handles are connected to the free ends of the tubing" (see Simpson, column 1, lines 25-30).

Major disadvantages of the above conventional exercise devices are caused by such metal or rigid connector attachments and/or handles which are not stable and move out of position, riding and slipping on the clothing and limbs of the users, as the users progress through their exercise routines, thus reducing the efficiency of exercise routines and causing injuries to the exercise device users, such as bruising and cuts and scrapes. Another disadvantage of conventional resistance exercise devices, is that the rigid connector attachments can cause the exercise straps and bands to tear or separate, thus increasing the possibility of injury to the resistance exercise device users. Additionally, conventional resistance exercise devices are not scalable and/or are not easily calibrated to be used for multi-functional, assisted resistance control during free motion exercises, or when using free weights or exercise machines. Most conventional exercise straps are not calibrated, but have labels characterizing the bands as merely being light weight (such as, light duty), medium weight (such as, medium duty) or heavy weight (heavy duty). Further, the conventional attachments along with the conventional resistance exercise devices are not easily adjustable to the different sizes and body types and varying strength levels of various users. Additionally, conventional wisdom suggests that 80% of United States citizens do not exercise, because exercise is traditionally associated with heavy weights, or cumbersome, one-size-fits-all cables and straps, all of which are considered to be difficult to use and if used improperly can cause serious injuries. Over time, and also due to environmental conditions, conventional resistance exercise bands tend to stretch, the coatings stiffen or crack and are prone to having abrasions and prone to look discolored or take on a dusty powdery appearance due to the solubility of rubber chemical compounds leading to what is known as bloom. (Because of the solubility of natural rubber compounds, some chemicals in the compound will flow and migrate in the rubber, giving the surface of the rubber the dusty powdery appearance).

Therefore the need exists for a resistance exercise system which is constructed of a single, continuous length of elastic flexible and/or stretchable tubing (solid, hollow, or extruded woven strands), banding, and/or strapping, formed in a continuous loop, by having the two free ends of the length of tubing, banding, and/or strapping knotted securely together, thus forming a continuous loop exercise device, having at least three scalable calibrated sections demarcated by a plurality of knotted sections (forming a chain of loops with knotted stays) strategically spaced along the length of the formed continuous loop device.

The need exists for an exercise system which can be used in the gym or packed in a briefcase or gym bag and carried easily anywhere, such as through security check points and used anywhere, anytime or even while commuting.

Further, the need exists for a resistance band exercise system having creative compound formulas designed to inhibit abrasions, and inhibit bloom, and further having compound formulas which will allow the exercise band to be less prone to cracks and be more resistant to oil, and other environmental conditions.

A preferred embodiment of the non-complex design of the Rope-A-Dope™ resistance exercise system eliminates the need for attachments or handles and/or connectors. The continuous loop having scalable calibrated sections can be connected to stationary hooks, knobs, handles affixed to walls doors and furniture, or other exercise machines and fixtures, or held by a second spotter (exercise personnel) allowing planned or spontaneous, as well as scheduled initiation of exercise routines in the gym, in the office or in the bedroom or any location convenient mobile or stationary platform for such exercises. This new and improved exercise apparatus can be easily calibrated to be used for multi-functional, assisted resistance control during free motion exercises, or when using free weights or exercise machines and can easily be adjusted to the different sizes and body types and varying strength levels of various users, while providing safe and injury free use. Also, in the preferred embodiment, the polymer ID of the rubber base can include a wide range of types of rubber to be used from natural gum rubber which exhibits strength, durability, flexibility and good rebound characteristics) to synthetic rubber, such as butadiene or polyurethane or EPDM (ethylene propylene diene monomer—which exhibits resistance to environmental conditions) or extruded latex (rubber strands or rods dipped in latex and formed by coagulation). The base polymer ID can be compounded to have performance specifications associated with anti-abrasion and anti-bloom properties and/or compounded with EPDM which has good oil resistance (even resistance to oils found on human skin) as well as resistance to ozone, oxidation and other environmental elements.

BRIEF SUMMARY OF THE INVENTION

The present invention provides solutions to the short comings in the related art of resistance exercise devices, by eliminating the use of metal or rigid connector attachments and/or handles which are not stable and move out of position, riding and slipping on the clothing and limbs of the users, as the users progress through their exercise routines, thus reducing the efficiency of exercise routines and causing injuries to the exercise device users, such as bruising and cuts and scrapes. Furthermore, the present invention provides a solution to the short comings of the related art resistance exercise devices by providing a stronger more reliable resistance exercise device which will not separate under high resistance forces. Additionally, the present invention provides a resistance exercise device which is easily adjustable, scalable and/or easily calibrated to be used for multi-functional, assisted, resistance control, free motion exercises, or when using free weights or exercise machines. Further, the present invention provides solutions to the short comings in the related art of resistance exercise devices by providing a resistance exercise device and system, which includes adjustments for different sizes and body types and persons having varying strength levels and/or disabilities.

BRIEF DESCRIPTION OF THE DRAWINGS

FIG. 7 also illustrates the method of performing pushups using the OneBand continuous loop (200) exercise system, by draping the continuous loop (200) exercise system over the shoulders and grasping the ends of section (4S4) and (4S1) by the right and left hands respectively.

FIG. 14A, FIG. 14B, FIG. 14C, FIG. 14D, FIG. 14E, FIG. 14F, FIG. 14G, FIG. 14H, FIG. 14I, FIG. 14J, and FIG. 14K illustrate force calculations for Latex Dipped Natural Rubber Compounds for a black rubber tube and a black rubber rectangular band. In particular, FIG. 14F illustrates a stress strain curve chart with tensile strength values in psi on the Y axis of the chart for the Latex Dipped Natural Rubber Compounds.

FIG. 15A, FIG. 15B, FIG. 15C, and FIG. 15D illustrate force calculations for High Elongation EPDM (Ethylene Propylene Diene Monomer) Rubber Compounds. In particular, FIG. 15 illustrates a stress strain curve chart with tensile strength values in psi on the Y axis of the chart for the High Elongation EPDM Rubber Compounds.

FIG. 15E, FIG. 15F, and FIG. 15G illustrate force calculations for EPDM black rubber tube and black rubber rectangular band Rubber Compounds. In particular, FIG. 15 G illustrates a stress strain curve chart with tensile strength values in psi on the Y axis of the chart for the EPDM Rubber Compounds.

FIG. 16A, FIG. 16B, FIG. 16C, and FIG. 16D illustrate force calculations for Black Tube and Rectangle Natural Rubber Compounds. In particular, FIG. 16D illustrates a stress strain curve chart with tensile strength values in psi on the Y axis of the chart for Natural Rubber Compounds.

The above described drawings present exemplary images of the various exercises which can be performed using the OneBand exemplary embodiments, but the present invention and the various exercises shown in the above drawings are not limited to the drawings discussed above; moreover various other exercises incorporate the features of using the exemplary embodiments of the OneBand exercise system, i.e., drawings of various exercises which can implement use of the OneBand exercise system and which number at or about 1000 or more different types of exercise drawings.

DETAILED DESCRIPTION OF THE INVENTION

The disclosed embodiments are intended to be illustrative only, since numerous modifications and variations therein will be apparent to those of ordinary skill in the art. Further, the terms "a", "an", "first", "second" and "third" herein do not denote limitations of quantity, but rather denote the presence of one or more of the referenced item(s). In reference to the drawings, like numbers will indicate like parts continuously throughout the views.

Figure 1A:
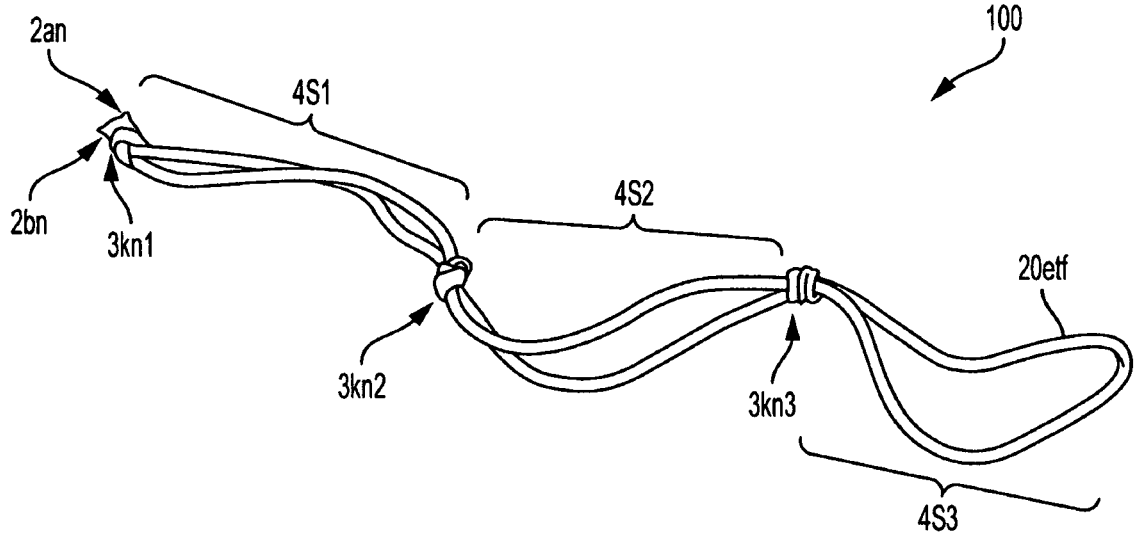
FIG. 1A illustrates a single, continuous length of elastic flexible and/or stretchable tubing, banding, and/or strapping, formed in a continuous loop, by having the two free ends: free end (2*an*) and free end (2*bn*) of the length of elastic flexible tubing (20*etf*), banding, and/or strapping knotted securely together, thus forming a continuous loop (100) exercise device/system, having at least three scalable calibrated sections demarcated by a plurality of knots (3*kn*) forming a plurality of knotted sections (4), wherein the knots (3*kn*) can also be referred to as knotted stays (3*kn*) forming the plurality of knotted sections (4), which can also be referred to as a plurality of loops chained together as knotted sections (4), where the knotted stays (3*kn*) are strategically spaced along the length of the formed continuous loop device to facilitate the scalable calibrated knotted sections (4). The knotted stays (3*kn*) are tied together before the two free ends, such as free end (2*a*) and free end (2*b*) are tied together.

Referring to FIG. 1A, in a first, preferred embodiment, the present invention, referred to herein as the Rope-A-Dope™ continuous loop (100) exercise system, comprises a single, continuous length of elastic flexible and/or stretchable tubing, banding, and/or strapping, formed in a continuous loop, by having the two free ends: free end (2*an*) and free end (2*bn*) of the length of elastic flexible tubing (20*etf*), banding, and/or strapping knotted securely together, thus forming a continuous loop (100) exercise device/system, having at least three scalable calibrated sections demarcated by a plurality of knots (3*kn*) forming a plurality of knotted sections (4), wherein the knots (3*kn*) can also be referred to as knotted stays (3*kn*) forming the plurality of knotted sections (4), which can also be referred to as a plurality of loops chained together as knotted sections (4), where the knotted stays (3*kn*) are strategically spaced along the length of the formed continuous loop device to facilitate the scalable calibrated knotted sections (4).

Each loop is one foot. And 6 feet plus 11 inches (i.e., equals 83 inches) of rubber tubing is required to make the rope. 36/75 will be needed to start with (and 78 for gray). Ends should be 3 centimeters (cm) from the tip. Color coding will be used to designate resistance levels. In exemplary embodiments:

(1) Red indicates light resistance level;
(2) Green indicates lighter resistance level;
(3) Blue indicates medium resistance level; and
(4) Gray indicates hard/difficult resistance level,
wherein, the various levels are associated with varying tensile strengths and varying resistance forces, depending on varying configurations of the exercise system.

Figure 10A:
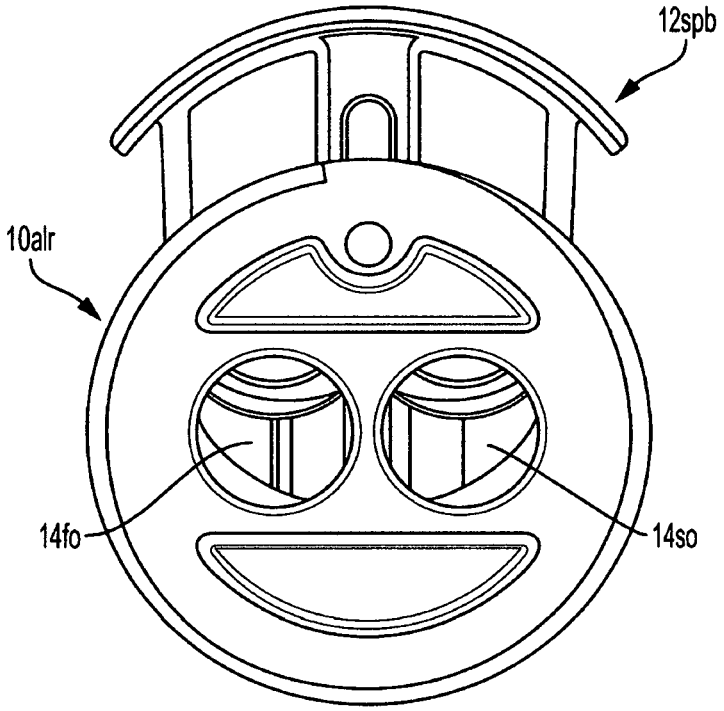
FIG. 10A illustrates an adjustable-locking-release (10*alr*) mechanism, having a first opening (14*fo*) and a second opening (14*so*).
Figure 10B:
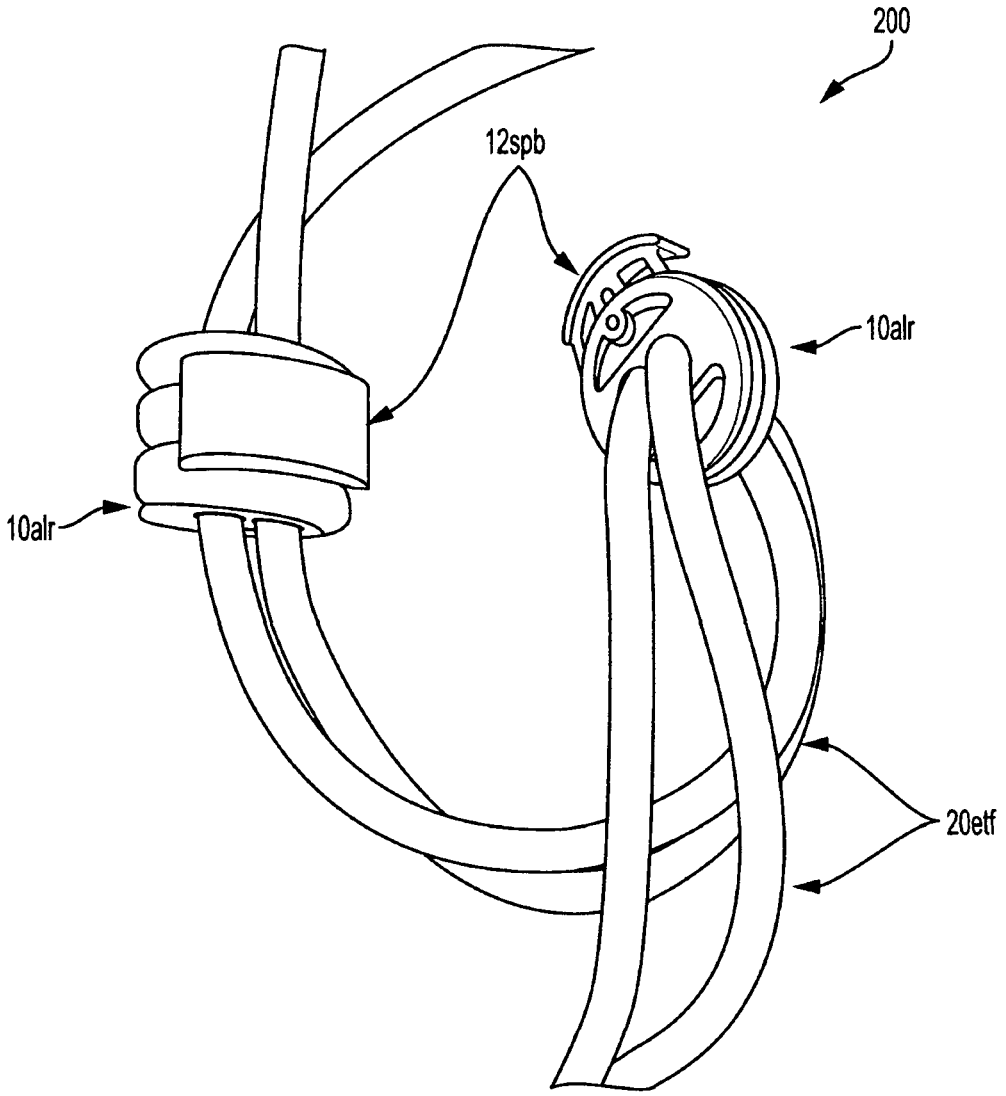
FIG. 10B and FIG. 10C, illustrate the replacement of the slidably adjustable roller stay (10*sar*) illustrated in FIG. 9 with an adjustable-locking-release (10*alr*) mechanism through which the length of elastic flexible tubing (20*etf*) folded into the form of a section (4S3) and both ends of the elastic flexible tubing (20*etf*) threaded through the opening of the adjustable-locking-release (10*alr*) and can be used as a handle for the exercise user to hold onto, while performing exercises with the continuous loop exercise system. Furthermore, the body of the adjustable-locking-release (10*alr*) mechanisms can be either narrow (having one layer thick) or wide (having three layers thick) as illustrated in FIG. 10B; and the adjustable-locking-release (10*alr*) mechanism is slidably coupled to the elastic flexible tubing (20*etf*). Further, FIG. 10C can have a battery operated electronic scale (30*scl*) removably attached (using loops, or buckles, or rings, or clamps, or handles or snaps or straps or a strap (14*vs*)) securely around the flexible tubing (20*etf*), where the battery operated electronic scale (30*scl*) can be gripped by the user to exert resistive force being measured in lbs or kilograms, located in a plurality of scalable calibrated sections, having a plurality of adjustable-locking-release (10*alr*) mechanisms (from two up to about ten) allowing size and shape adjustments to the scalable calibrated sections, where the scalable calibrated sections are marked and/or color coded and/or have one or multiple battery operated electronic scales having a digital display showing pounds or kilograms, and wherein the battery operated electronic scale (30*scl*) is attached to a first loop of a first 12 inch section of the elastic, flexible, stretchable tubing (20*etf*) by the strap (14*vs*), and wherein the battery operated electronic scale (30*scl*) can be a digital scale.

The knotted stays (3*kn*) are tied together before the two free ends, such as free end (2*a*) and free end (2*b*) are tied together, wherein, the plurality of knots (3*kn*) can be designated as knots: (3*kn*1); (3*kn*2); (3*kn*3); (3*kn*4); (3*kn*5); (3*kn*6); up to (3*kn*26), respectively. The knotted stays (3*kn*) can be substituted with adjustable stays, such as the releasable adjustable stay illustrated in FIG. 8, as adjustable stay (8*sa*). Also, the knotted stays (3*kn*) can be substituted with slidably adjustable roller stays (10*sar*), as illustrated in FIG. 10A, FIG. 10B; and FIG. 10C. And, wherein, the plurality of knotted sections (4) can be designated as sections (4S1); (4S2); (4S3); (4S4); (4S5); (4S6) up to (4S26) respectively. Furthermore, the knotted stays (3*kn*) can be substituted with hard rubber or wooden slidably adjustable slip stays (12*ssa*), as illustrated in FIG. 12A and FIG. 1213.

Figure 1B:
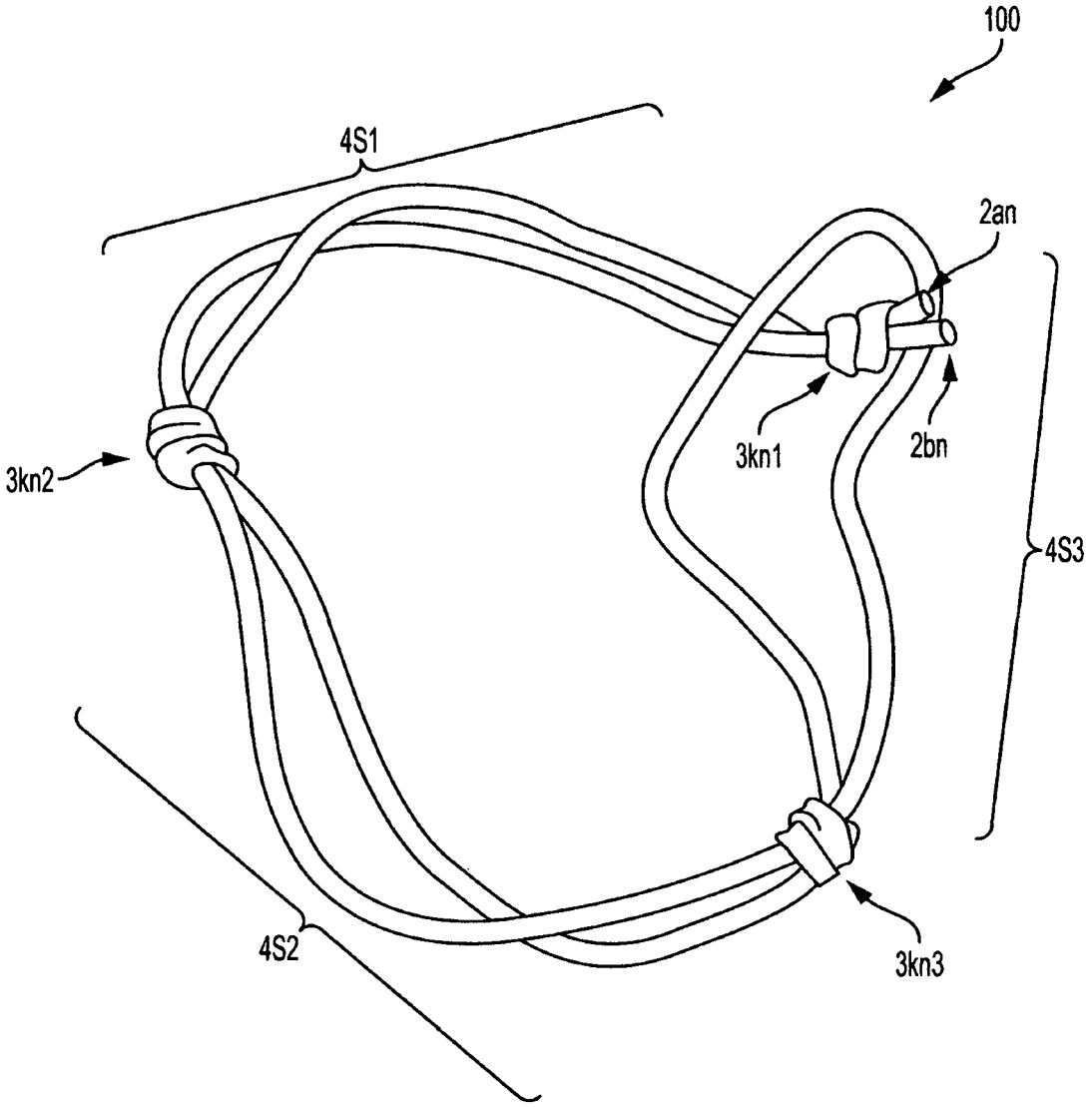
FIG. 1B shows the OneBand continuous loop (100) exercise system configured to attach to an exercise machine or configured to reduce the length of the exercise system by threading one end, such as, the knotted end (3*kn*1) of the exercise device through one of the plurality of knotted sections (4); also see FIG. 4 and FIG. 6.
Figure 4:
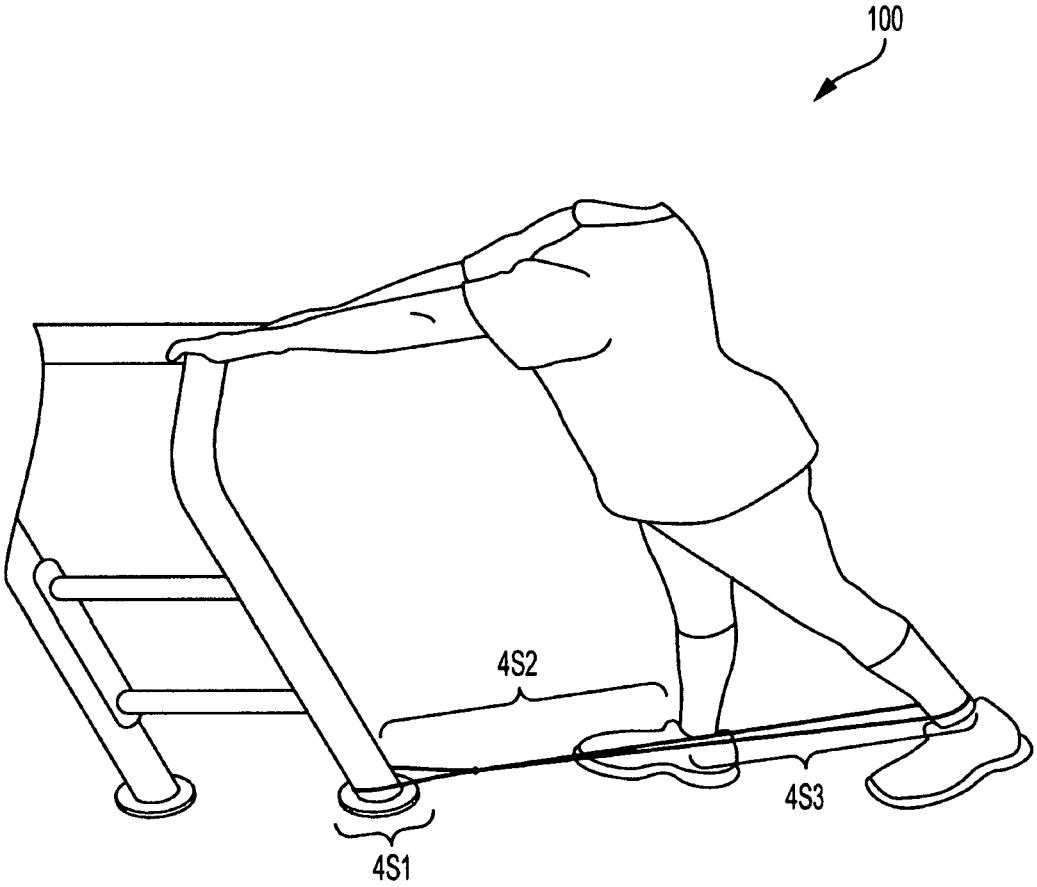
FIG. 4 illustrates the method of performing a standing back leg raise exercise using the OneBand continuous loop (100) exercise system, by looping the knotted section (4S1) of the OneBand continuous loop (100) exercise system around the leg of an exercise machine.
Figure 6:
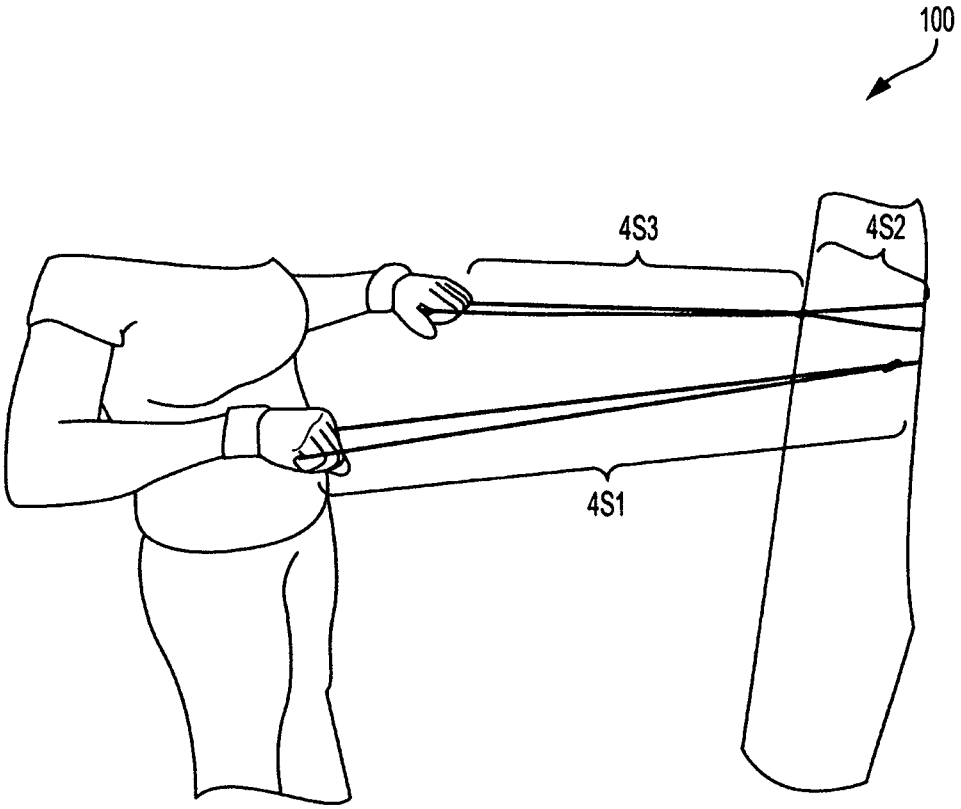
FIG. 6 illustrates the method of performing a standing, two arm, high, lat pull, using the Rope-A-Dope continuous loop (100) exercise system, by looping the knotted section (4S1) of the Rope-A-Dope continuous loop (100) exercise system around the leg or column or support beam of a stationary load bearing fixture.

Referring to FIG. 1B, in the preferred embodiment, the OneBand continuous loop (100) exercise system is configured to attach to an exercise machine or configured to reduce the length of the exercise system by threading one end, such as, the knotted end (3*kn*1) of the exercise device through one of the plurality of knotted sections (4); also see FIG. 4 and FIG. 6. The continuous loop (100) exercise system can be used in the gym or packed in a briefcase of a gym bag or suit case or back pack and carried easily anywhere, such as through security check points and used anywhere, anytime or even while commuting in various mobile platforms. In a preferred embodiment, the non-complex design of the OneBand resistance exercise system eliminates the need for attachments or handles and/or connectors. The continuous loop having scalable calibrated sections can be connected to stationary hooks, knobs, handles affixed to walls doors and furniture, or other exercise machines and fixtures, allowing planned/scheduled or spontaneous initiation of exercise routines in the gym, in the office or in the bedroom or any location convenient for such exercises. This new and improved exercise system can be easily calibrated to be used for multi-functional, varying configurations of assisted resistance control during free motion exercises, or when using free weights or exercise machines and can easily be adjusted to different sizes and body type by having adjustments for different sizes and body types and varying strength levels (including exercise system users who are young children from ages of eight up to older/senior exercise system users reaching ages up to about one hundred years old or more; and obese patients in rehabilitation facilities), while providing safe and injury free exercise use, due to features of the present invention, which include regulating exercises within the range of motion and strength levels of individual users, where these users include patients undergoing and/or participating in medical and rehabilitation therapy, as well as aerobic exercises, body building exercises, FITBIT® adaptation exercises, TRX® Workout Training, YOGA exercises, and general band Flexibility training and other exercise routines, which change lives and change bodies by facilitating health benefits derived from exercises performed properly. Additional features include small size, light weight, portable, adaptable, convenient exercise systems, which can be easily transported, easily configured for multiple exercise routine adaptations, also precisely calibrated for precision physical therapy and rehabilitation applications, and having relatively minimal cost, and less prone to causing user injuries as compared to pumping iron systems, or even using pneumatic or hydraulic exercise systems. The OneBand resistance exercise systems will reduce or eliminate and/or help rehabilitate users suffering from tendonitis, or tendon tears or muscle strain.

Additional embodiments of the OneBand resistance exercise system can be adapted to FITBIT® connected routines, such as, where analog and digital electronic computer based measurement devices, including scales, are mechanically and/or electronically integrated into and seamlessly coupled (using radio broadcast or RFI or fiber optic circuits and even mechanical connectors) with the OneBand resistance exercise band systems in manners such as wearable computer technology applications having direct precision calibration and measurement capabilities, associated with exercise routines.

Figure 2:
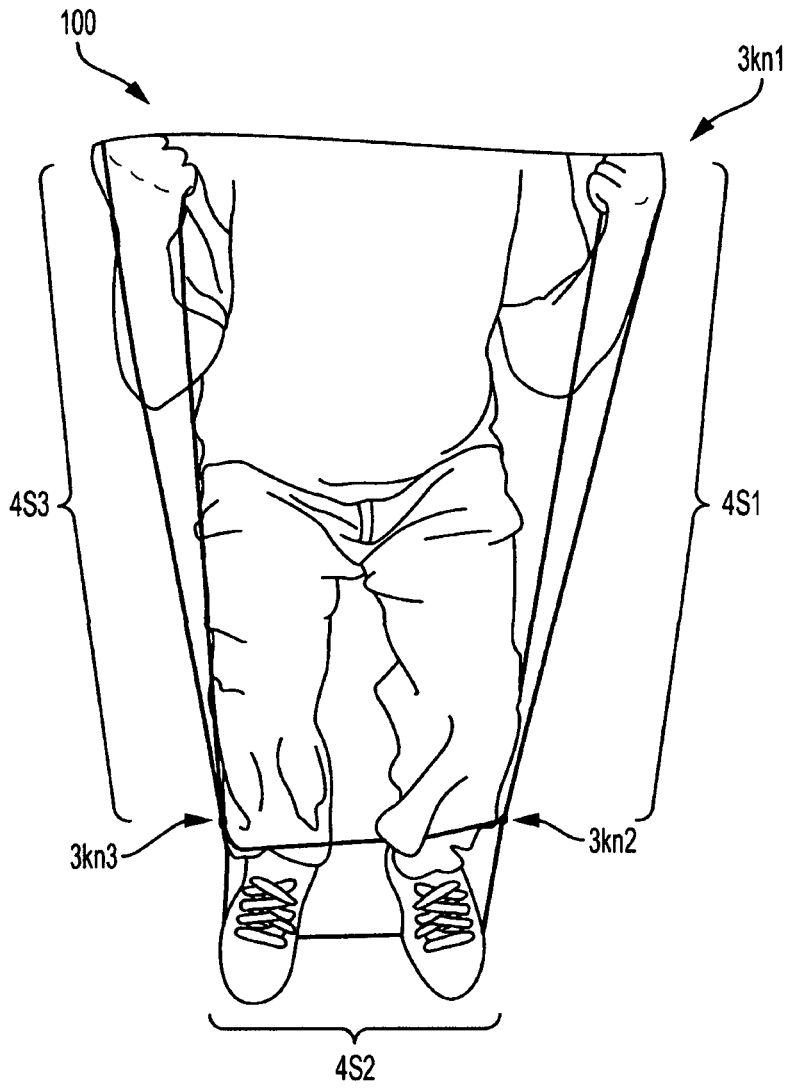
FIG. 2 shows the method of performing seated bicep curls illustrating placement of the feet on one side of the calibrated knotted section (4S2) of the OneBand continuous loop (100).

Referring to FIG. 2, the OneBand continuous loop (100) exercise system is used in a method of performing seated bicep curls illustrating placement of the feet on one side of the calibrated knotted section (4S2) of the OneBand continuous loop (100). The exercise user grips an end of knotted section (4S3) with the right hand and grips the knotted end (3*kn*1), then slowly performs an arm curling motion, using both hands, while holding the elbows close to the body above the hips, wherein any one or more of the plurality of knotted stays (3*kn*1), (3*kn*2), and (3*kn*3) can be loosened and moved to different positions slidably along the length of the elastic flexible tubing (20*etf*), banding, and/or strapping, and then the knotted stays can be re-tightened, to accomplish adjustability of the continuous loop (100) resistance band exercise system.

Figure 3:
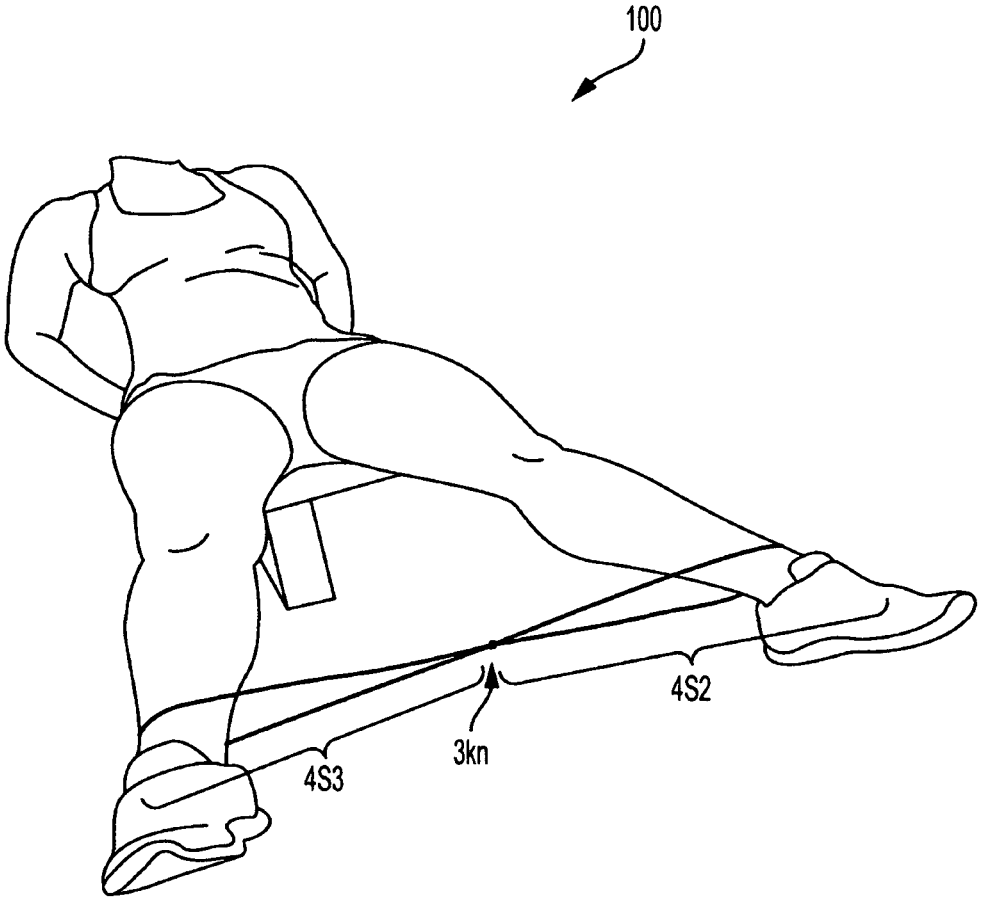
FIG. 3 illustrates the method of performing a combination leg raise, outer thigh and hip exercise using two knotted sections (4S2) and (4S3) of the OneBand continuous loop (100) exercise system.

Referring to FIG. 3, the OneBand continuous loop (100) resistance band user is shown performing a combination leg raise, outer thigh and hip exercise using only two knotted sections (4S2) and (4S3) of the OneBand continuous loop (100) exercise system. FIG. 3 illustrates an exemplary configuration of the varying configurations of the continuous loop (100) exercise system for using just two sections, i.e., knotted section (4S2) and knotted section (4S3) for modified resistance band combination outer thigh and hip exercises.

Referring to FIG. 4, the Rope-A-Dope continuous loop (100) exercise system's knotted section (4S1) is looped around the leg of an exercise machine and then the knotted end (3*kn*1) is threaded through the knotted section (4S1) securing the loop on the leg of the exercise machine, and the continuous loop (100) exercise system user positions her left heel inside the end of the knotted section (4S3) facilitating performing a standing back leg raise exercise. Therefore, FIG. 4 illustrates an exemplary configuration of the plurality of varying configurations of the continuous loop (100) exercise system for using just two sections, i.e., knotted section (4S2) and knotted section (4S3) as a modified resistance band back leg raise exercise.

Figure 5:
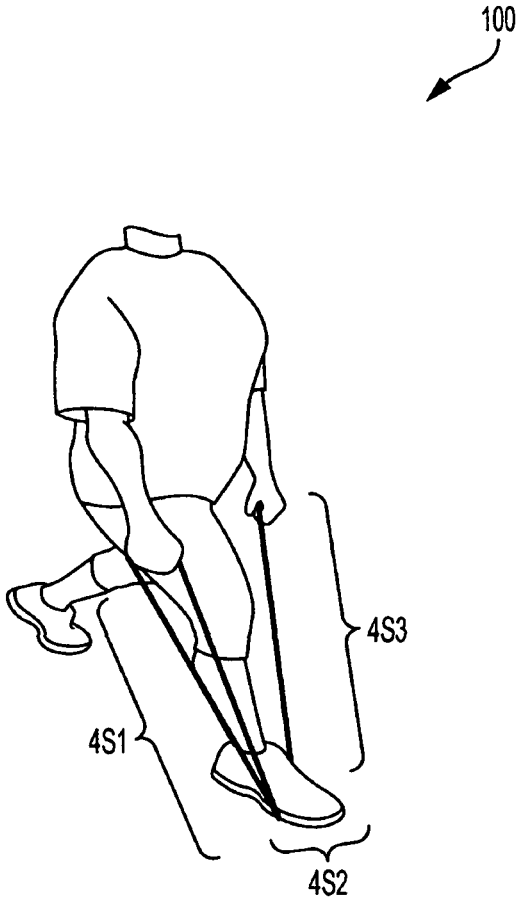
FIG. 5 illustrates the method of performing a front lunge exercise using the OneBand continuous loop (100) exercise system by placement of the right foot on one side of the calibrated knotted section (4S2).

Referring to FIG. 5, the user places her right foot on one side of the calibrated knotted section (4S2), and grips the knotted end (3*kn*1) with her right hand, and grips the end of the knotted section (4S3) with her left hand and performing a front lunge exercise movement by placing her right foot and leg in the lunge position, using OneBand continuous loop (100) exercise system. Therefore, FIG. 5 illustrates an exemplary configuration of the varying configurations of the continuous loop (100) exercise system.

Referring to FIG. 6, the OneBand continuous loop (100) exercise system's knotted section (4S2) is looped around a column, securing the continuous loop (100) exercise system for use by the resistance band exercise system user to grip the knotted end (3*kn*1) in her right hand and grip the end of knotted section (4S3) in her left hand allowing the user to perform a standing, two arm, high, lat pull, using the OneBand continuous loop (100) exercise system. Therefore, FIG. 6 illustrates an exemplary configuration of the varying configurations of the continuous loop (100) exercise system.

Figure 7:
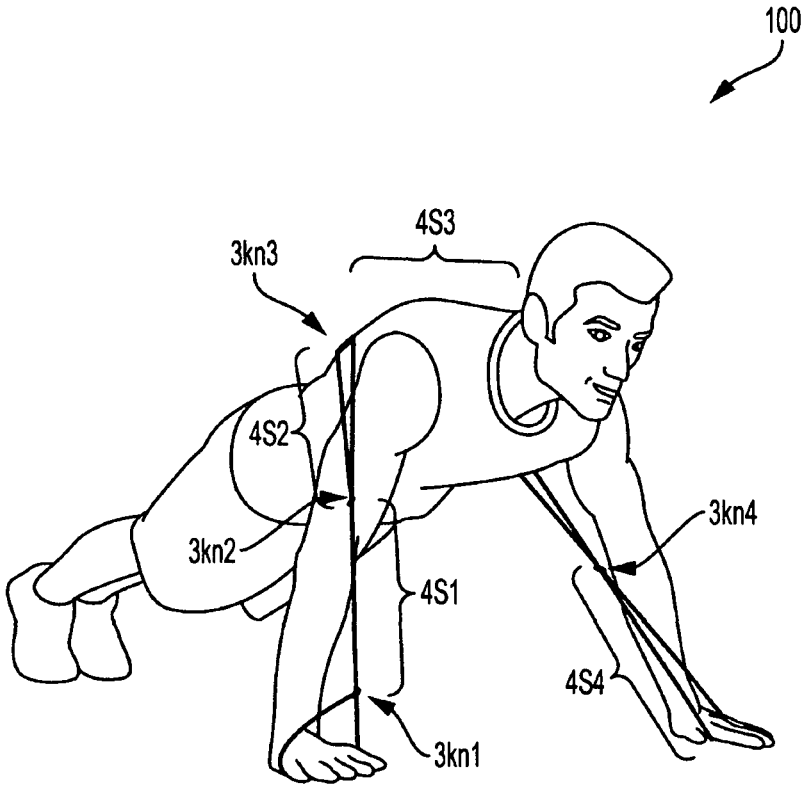
FIG. 7 illustrates the OneBand continuous loop (200) exercise system (having four knotted sections (4S1), (4S2), (4S3) and (4S4).

In further embodiments, referring to FIG. 7, the OneBand second embodiment continuous loop (100) exercise system having four knotted sections (4S1), (4S2), (4S3) and (4S4), the method of performing pushups is illustrated using the OneBand second embodiment continuous loop (100) exercise system, by draping the second embodiment continuous loop (100) exercise system over the shoulders and the user grasping the ends of section (4S4) and (4S1) by the right and left hands respectively. Furthermore, with four knotted sections, the length of the second embodiment continuous loop (100) exercise system can be folded in half to increase the resistance force (see equation (1), equation (2), equation (3) and equation (4) below) needed to be applied to the exercise system, by differing users some stronger, some weaker, requiring less force resistance. This new and improved exercise apparatus can be easily calibrated to be used for multi-functional exercises, in varying configurations of assisted resistance control during free motion exercises, or when using free weights or exercise machines and can easily be adjusted to the different sizes and body types, having adjustments for different sizes and body types and varying strength levels (including exercise system users who are young children from the age of eight up to older/senior exercise system users reaching the age of up to one hundred years old or more; and obese patients in rehabilitation facilities or other patients in various stages of health and rehabilitation can benefit from using the continuous loop (100) exercise system), while providing safe and injury free use. Thus FIG. 7 illustrates an exemplary configuration of the varying configurations of the second embodiment continuous loop (100) exercise system; and wherein:

In physics, resistance force is the force which an effort force must overcome in order to do work on an object via a simple machine. Resistance force, like most other forces, is measured in Newtons or in pounds-force . . . resistance force obeys the equation . . . [:]

$$R \times D_R = E \times D_E \quad (1)$$

where:

R equals resistance force $D_R$ equals resistance distance

E equals effort force; and $D_E$ equals effort distance

. . .

Resistance force is used to calculate the work output using the following equation:

$$\text{Workoutput} = R \times D_R \quad (2)$$

RESISTANCE FORCE. WIKIPEDIA, https://en.wikipendia.org/wiki/Resistance force. [Internet] Accessed 21 Apr. 2017.

Additionally, the "modulus of elasticity (also known as the elastic modulus, the tensile modulus) is a number that measures an object or substance's resistance to being deformed elastically (i.e., non-permanently) when a force is applied to it. The elastic modulus of an object is defined as the slope of its stress-strain curve in the elastic deformation region . . . . A stiffer material will have a higher elastic modulus. An elastic modulus has the form:

$$\lambda \underset{def}{=} \text{stress/strain} \quad (3)$$

where stress is the force causing the deformation divided by the area to which the force is applied; and strain is the ratio of the change in some length parameter caused by the deformation to the original value of the length parameter.

Elastic modulus. WIKIPEDIA, https://en.wikipedia.org/wiki/Elastic modulus. [Internet] Accessed 27 Apr. 2017.

Tensile modulus (i.e., Tensile strength can be represented in units of Pascals (Pa) [also Mega Pascals (MPa)] or pounds per square inch (psi) where:

$$1\ \text{MPa} = 145\ \text{psi} \quad (4)$$

Tensile Strength. WIKIPEDIA, https://www.oringsusa.com/html/tensile-strength.html. [Internet] Accessed 27 Apr. 2017.

The Tensile strength for natural rubber is 4800 psi. Typically, the Tensile strength for elastomers, natural rubber and polyesters and various rubber compounds, vary from about between 600 psi up to about 6000 psi. (Tensile Strength. WIKIPEDIA, https://us.wow.com/image?q= rubber+ tensile+ strength+chart&s it=imag-ans&imgId= F3B1AC1F3432937E94D0553D8DF3cfE78A11DA5&s chn=263&s pt=ao . . . [Internet] Accessed 27 Apr. 2017).

The rubber tubing, elastomer resistance bands, and straps disclosed herein as exemplary embodiments are tested for tensile strength using tensometers according to ASTM D 412 etc. standard specifications. And from such testing, the various proportional forces measured in Newtons, associated with the tensile strengths of the various resistance exercise bands and straps composed of rubber and elastomer samples disclosed herein comprising tensile strengths varying from a range of about 600 psi up to about 6000 psi.

Preferred embodiments of the OneBand continuous loop (100) (200) and (300) exercise systems range from either a natural rubber latex or polyisoprene latex (synthetic natural rubber). Even though some conventional exercise bands are formed from latex dipped manufacturing processes, the initial product produced for the OneBand continuous loop (100) (200) (300) exercise systems will comprise a solid mixed compounds or hollow tube compounds that achieve tensile strength values that will be close to the latex dipped, ranging from about 2000~5000 psi tensile strength; more particularly ranging from about 2300 psi up to about 4894 psi, having a polymer blend of natural rubber and EPDM (ethylene propylene diene monomer), where, the compounds are made as strong as possible; and different tension force values are controlled by the thickness of the part.

In alternate embodiments of the OneBand continuous loop (100) exercise system, the OneBand continuous loop (200) exercise system and the OneBand continuous loop (300) exercise system, a plurality of knotted stays (4S1), (4S2), (4S3), (4S4), up to (4S26) can be implemented into the first, second and third embodiments.

Figure 8:
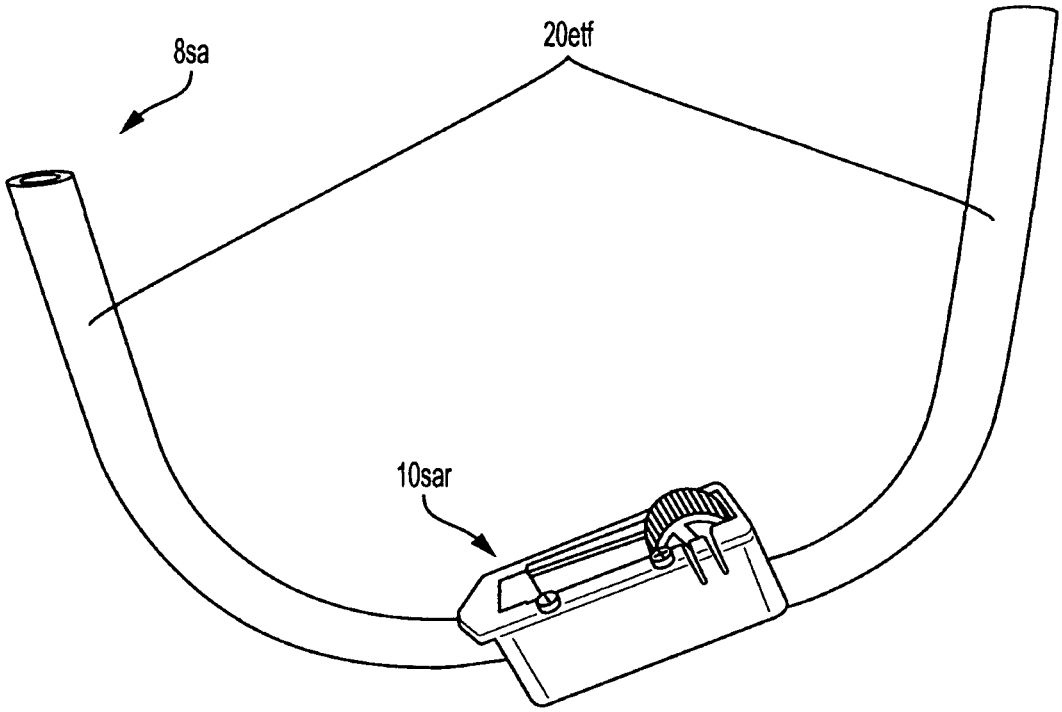
FIG. 8 PRIOR ART
FIG. 8 illustrates a conventional adjuster roller valve as used to control water flow volume in a conventional toilet, as disclosed in US Patent Application Publication US2010/0037380 assigned to FLUIDMASTER®.

FIG. 8 illustrates a conventional the adjuster roller valve (10*sar*) initially designed to control water flow volume in a conventional toilet, as disclosed in US Patent Application Publication US2010/0037380 assigned to FLUIDMASTER®. Additional embodiments include adjustable stays that are formed in the shape of a knot. Even though FIG. 8 illustrates a conventional adjuster roller valve (10*sar*), said adjuster roller valve can be modified to be used, in a manner not anticipated in US2010/0037380 patent application publication to FLUIDMASTER, to form an alternate embodiment of the adjustable stays of the present invention, in a way that provides unexpected results when used as an adjustable stay in the various embodiments of the present invention.

Figure 9:
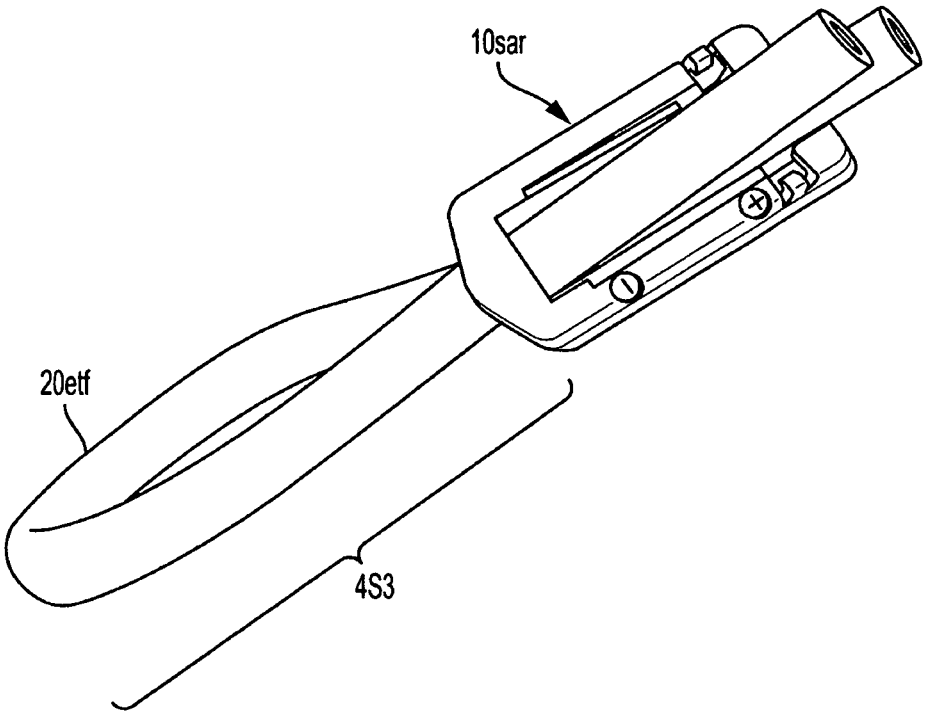
FIG. 9 illustrates a length of elastic flexible tubing (20*etf*) folded into the form of a section (4S3) and both ends of the elastic flexible tubing (20*etf*) threaded through the hole at the non-roller end of the slidably adjustable roller stay (10*sar*).

In an alternate exemplary embodiment, referring to FIG. 9, a length of elastic flexible tubing (20*etf*) folded into the form of a section (4S3) and both ends of the elastic flexible tubing (20*etf*) threaded through the hole at the non-roller end of the slidably adjustable roller stay (10*sar*) thus forming a replacement for the knotted stay (3*kn*3) and thus forming a slidably adjustable section (4S3).

As illustrated in FIG. 9 the adjuster roller valve can be modified to form a slidably adjustable roller stay (10*sar*) in the OneBand continuous loop exercise system (100); and by adding more slidably adjustable roller stays (10*sar*) the alternate embodiments can include up to six or more interchangeable exercise band/or rope or strap extensions (connected or unconnected) slidably adjustable sections, up to at least twenty-six slidably adjustable sections.

Figure 10C:
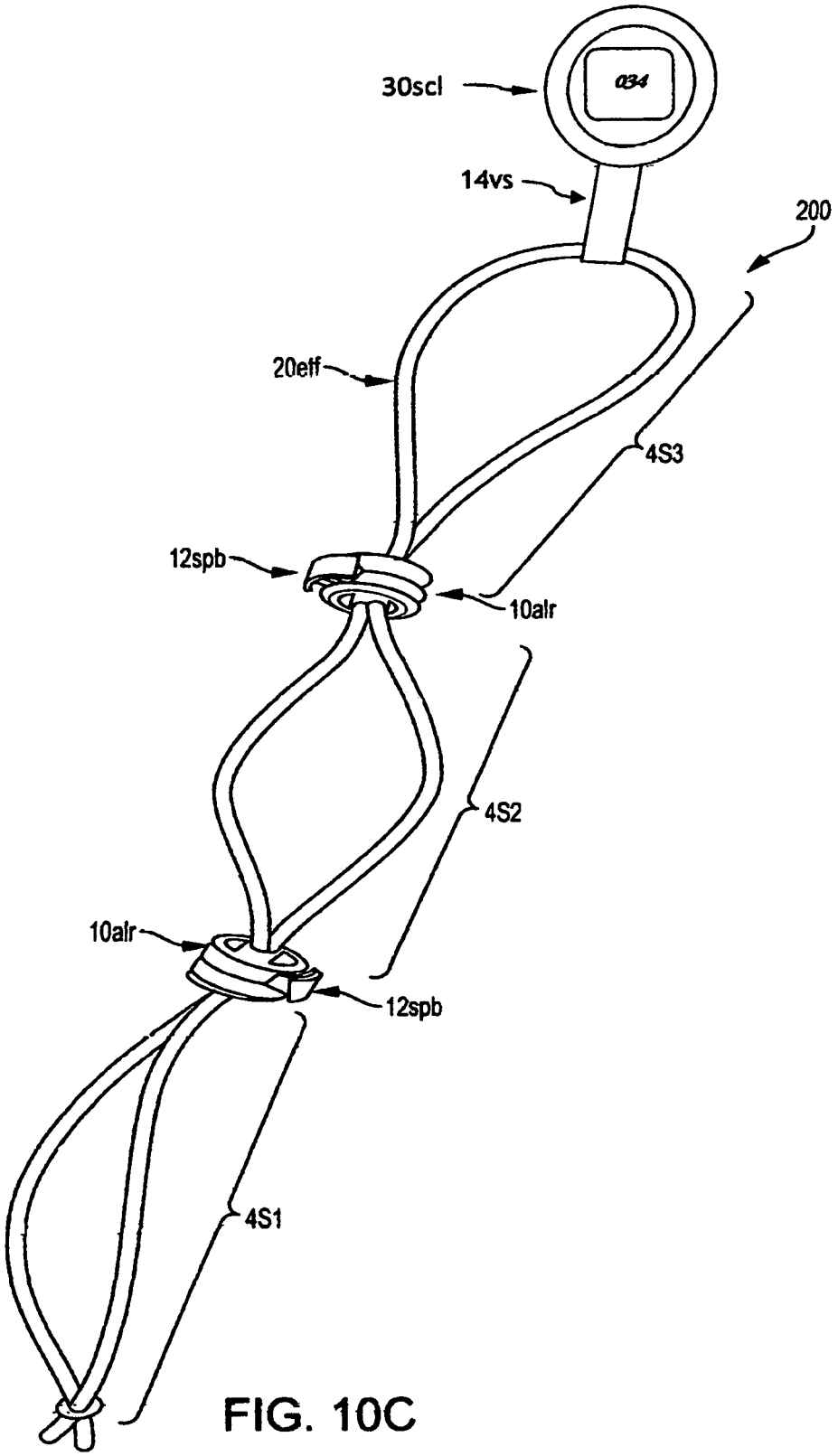

Referring to FIG. 9, FIG. 10B and FIG. 10C, in an alternate exemplary embodiment of the OneBand continuous loop (200) exercise system, the slidably adjustable roller stay (10*sar*) illustrated in FIG. 9 is replaced with an adjustable-locking-release (10*alr*) mechanism illustrated in FIG. 10A, FIG. 10B and FIG. 10C through which the length of elastic flexible tubing (20*etf*) folded into the form of a section (4S3) and both ends of the elastic flexible tubing (20*etf*) threaded through the opening of the adjustable-locking-release (10*alr*), thus forming a replacement for the knotted stay (3*kn*3) and thus forming the slidably adjustable section (4S3). The adjustable-locking-release (10*alr*) mechanism can be nylon or plastic or rubber. In this alternate exemplary embodiment, multiple adjustable-locking-release (10*alr*) mechanisms replace all of the adjustable roller stays (10*sar*) and are slidably coupled to the elastic flexible tubing (20*etf*), thus forming multiple sections (4S3). Furthermore, the body of the adjustable-locking-release (10*alr*) mechanisms can be either narrow (having one layer thick) or wide (having three layers thick) as illustrated in FIG. 10A. And, the adjustable-locking-release (10*alr*) mechanisms can be used as hand grips for the user to hold onto while performing exercises.

Again referring to FIG. 10A and FIG. 10B, tension of the spring pressure of the adjustable-locking-release (10*alr*) mechanism can be designed and/or adjusted with modifiable spring pressure interfacing with the elastic flexible tubing (20*etf*) inserted, thus providing more or less pressure from the adjustable-locking-release (10*alr*) mechanism adjacent to the surfaces of the elastic flexible tubing (20*etf*), thus inhibiting friction and abrasion between the adjustable-locking-release (10*alr*) mechanisms as they are slidably adjusted to different positions on the elastic flexible tubing (20*etf*), thus forming different sections (4S3), when a spring actuated push button (12*spb*) pressably connected to the adjustable-locking-release (10*alr*) mechanism is pressed and/or released by the user to either to release pressure or increase pressure on the inserted elastic flexible tubing (20*etf*) enabling movement of the adjustable-locking-release (10*alr*) mechanism back and forth over the elastic flexible tubing (20*etf*) when pressed, thus facilitating the formation of larger or smaller sections (4S3) (4S2) and/or (4S1) throughout a OneBand continuous loop having adjustable stays (200) exercise system.

Figure 11A:
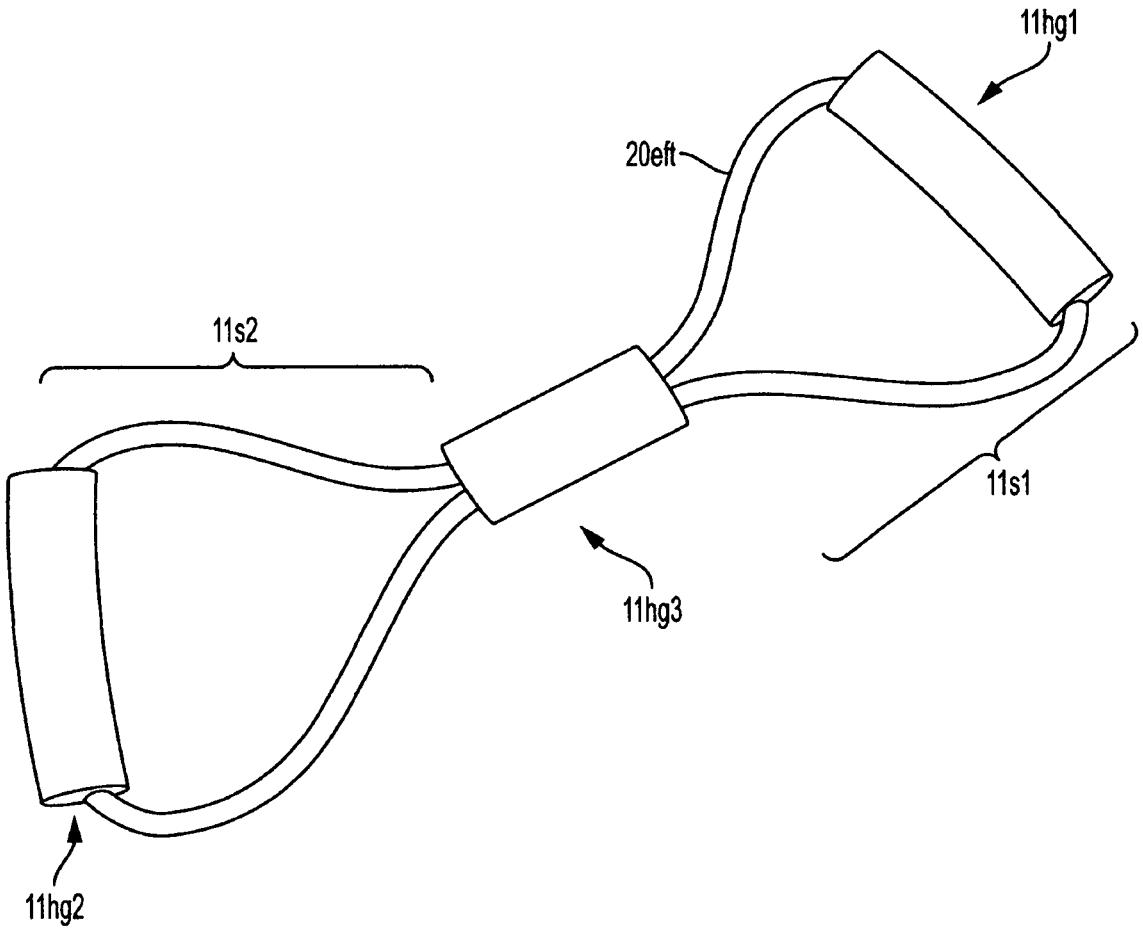
FIG. 11A PRIOR ART
FIG. 11A illustrates a conventional resistance exercise band, such as the PROSOURCE™ resistance band, having three soft foam hand grips (11*s*1), (11*s*2) and (11*s*3), which can also be used as and grips and/or foot grips.

Referring to FIG. 11A, a conventional resistance exercise band is illustrated, such as the PROSOURCE™ resistance band, having three soft foam hand grips (11*s*1), (11*s*2) and (11*s*3), which can also be used as hand grips and/or foot grips. Even though these hand grips/foot grips (11*s*1), (11*s*2), and (11*s*3) can be adapted to the various embodiments of the present invention, these hand grips/foot grips (11*s*1), (11*s*2) and (11*s*3), as used in the conventional resistance exercise apparatus are not stable and secure and easily slip out of position while being used. Also, the elastic flexible tubing (20*etf*) is not securely fastened together in the conventional resistance exercise apparatus and after extended use and/or when exposed to high resistance force (see equation (1), equation (2), equation (3) and equation (4) above), the elastic flexible tubing (20*etf*) will separate from its connector apparatus and come apart, causing the potential for injury to the user.

Figure 11B:
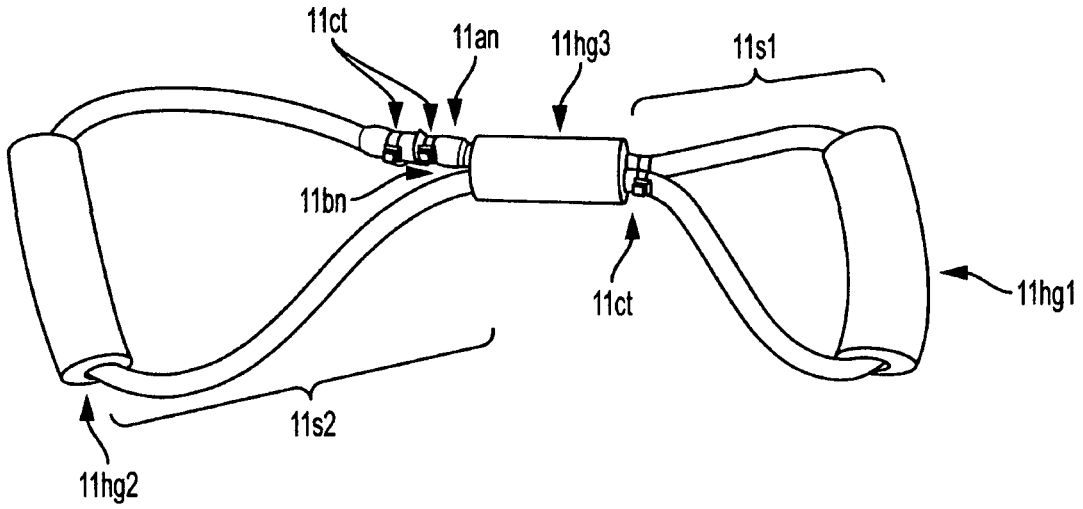
FIG. 11B PRIOR ART
FIG. 11B illustrates a conventional resistance exercise band, such as the SPORTS AUTHORITY© resistance band, having three soft foam hand grips (11*s*1), (11*s*2) and (11*s*3), which can also be used as hand grips and/or foot grips.

Referring to FIG. 11B, a conventional resistance exercise band, such as the SPORTS AUTHORITY® resistance band, includes three soft foam hand grips (11*s*1), (11*s*2) and (11*s*3), which can also be used as hand grips and/or foot grips. FIG. 11B further illustrates the need to modify the conventional resistance exercise band with cable ties (11*ct*) to hold the ends of the elastic tubing (20*etf*) together after extended use and high resistance force, and to hold the position of hand grip (11*hg*3) which in this illustration, serves as the adjustable stay.

Figure 12:
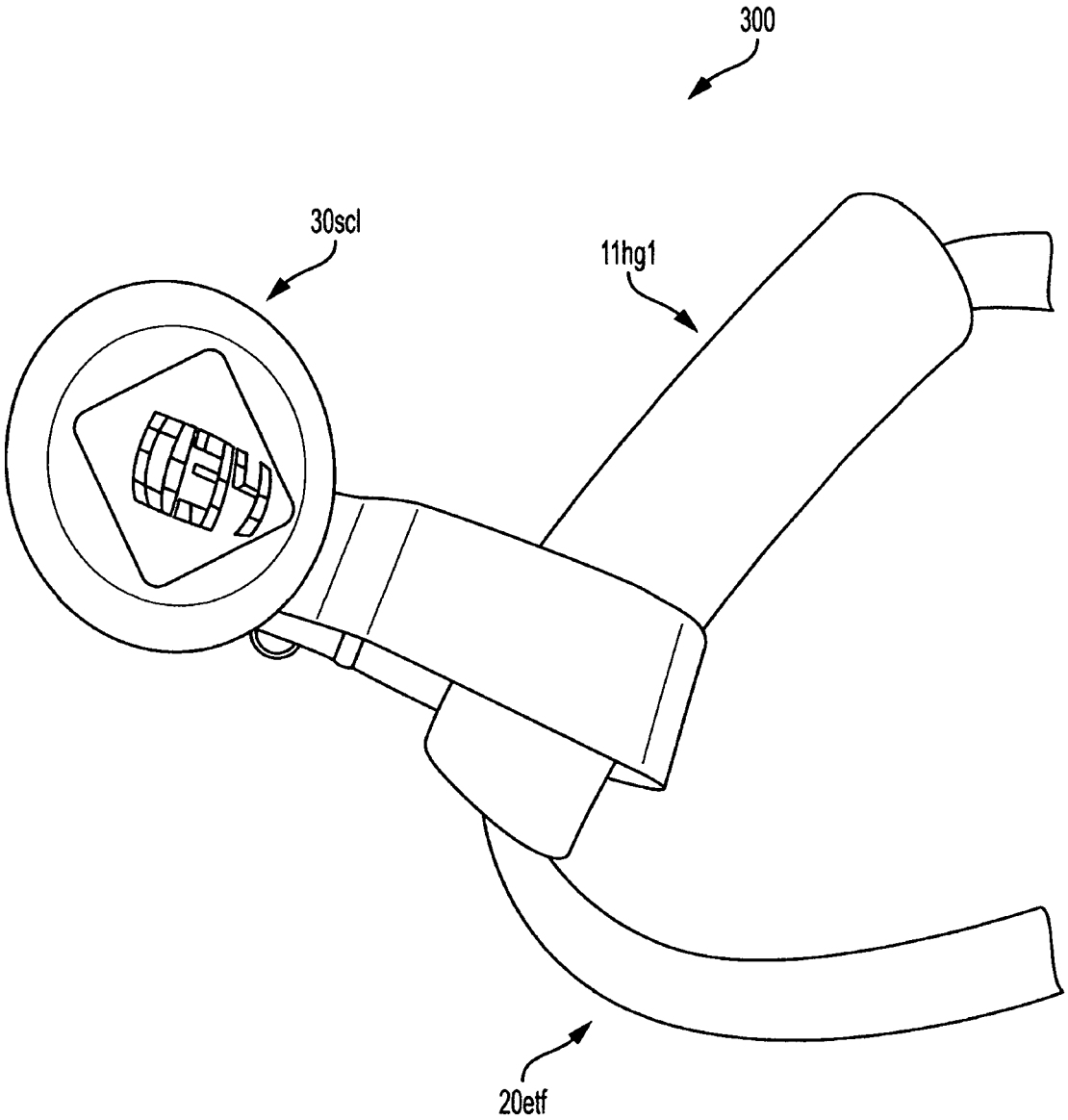
FIG. 12 illustrates a section (4S3) formed by the elastic flexible tubing (20*etf*) covered by an (11*hg*1) foam hand grip and further having a battery operated electronic scale (30*scl*) which measures force in pounds or kilograms attached securely around the (11*hg*1) foam hand grip.

Referring to FIG. 12, further embodiments of the OneBand resistance exercise system include a plurality of scalable calibrated sections, having a plurality of adjustable-locking-release (10*alr*) mechanisms (from two up to about ten) allowing size and shape adjustments to the scalable calibrated sections, where the calibrated sections are marked and/or color coded and/or have one or multiple battery operated electronic scales having a digital display showing pounds or kilograms, such as (30*scl*) illustrated in FIG. 12, to designate the specific amount of resistive force required for users to exert in order to operate the exercise system and to gain benefit from such operation. If additional interconnections of the OneBand continuous loop systems are required, the elastic flexible tubing (20*etf*) pieces can be either tied together, fused together using a molded stud or the adjustable-locking-release (10*alr*) mechanisms can be used to receive the insertion of two or more sets of elastic flexible tubing pieces into a given adjustable-locking-release (10*alr*). Because of the non-complex design of the OneBand resistance exercise system, all of the above advantages are achieved at reduced manufacturing costs, as compared to conventional resistance exercise devices. Furthermore, additional embodiments of the OneBand resistance exercise system can be adapted to FITBIT® connected routines, such as, where analog and digital electronic computer based measurement devices, including scales, such as scale (30*scl*) are mechanically and/or electronically integrated into and seamlessly coupled (using radio broadcast or RFI or fiber optic circuits and even mechanical connectors) with the OneBand resistance exercise band systems in manners such as wearable computer technology applications having direct precision calibration and measurement capabilities, associated with exercise routines.

Figure 13:
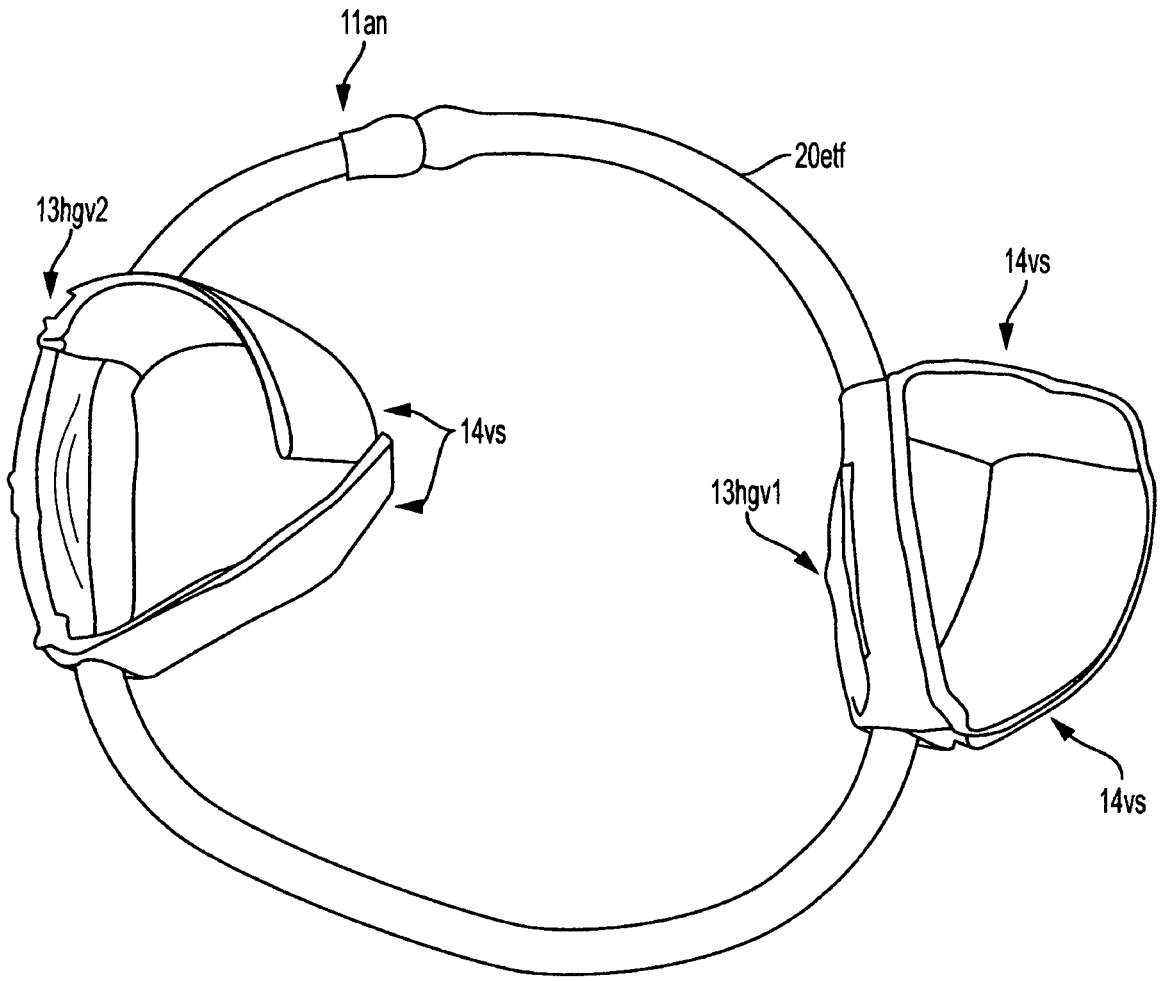
FIG. 13 PRIOR ART
FIG. 13 illustrates a conventional resistance band having soft hand grips (13*hg*v1) and (13*hg*v2), including VELCRO® securing straps (14*vs*). These hand grips can also be used as foot grips, which will not slide or slip on the user's clothing or limbs or skin of the exercise user.

Referring to FIG. 13, a conventional resistance band includes soft hand grips (13*hg*v1) and (13*hg*v2), including VELCRO® securing straps. These hand grips can also be used as foot grips, which will not slide or slip on the user's clothing or limbs or skin; these grips are designed to easily insert user's leg(s), hand(s) or wrist(s) into the grips. There is no sliding of the exercise bands or chaffing, scrapping, bruising or excessive intrusive pressures caused by the OneBand resistance exercise system.

The following discussions referring to FIG. 14A through FIG. 16D involve calculations for two natural rubber compounds and two EPDM (Ethylene Propylene Diene Monomer) compounds at four different sizes of tubes and ribbons and/or band straps, as to how the sizes impact pounds force over a range of 10% to 200% stretch of the rubber. Also included are the pound forces to break, based on the tensile properties of the compounds and the cross sectional area, as tested by AKRON RUBBER DEVELOPMENT LABORATORY, INC. (ARDL™).

Figure 14A:
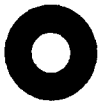
Figure 14D:
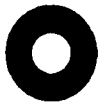
Figure 14E:
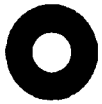

Referring to FIG. 14A, FIG. 14B, FIG. 14C, FIG. 14D, FIG. 14E, FIG. 14F, FIG. 14G, FIG. 14H, FIG. 14I, FIG. 14J, and FIG. 14K force calculations for Latex Dipped Natural Rubber Compounds for a black rubber tube and a black rubber rectangular band are presented in several views of a spreadsheet. In particular, FIG. 14F illustrates a stress strain curve chart with tensile strength values in psi on the Y axis of the chart for the Latex Dipped Natural Rubber Compounds. Properties of Black Tube and rectangular band Latex Dipped Natural Rubber Compounds are based on a band recipe formulary having a tensile strength of 4894 psi, as tested by ARDL. As described in FIG. 14A, at 10% stretch of the Latex Dipped Natural Rubber black tube exercise band, the force exerted by the user to stretch the tube by 10% is 9 lbs; and, it is noteworthy that the pounds force it will take to break this exercise band will be 945.9 lbs. This particular compound will be very difficult to break while a user is performing exercises. Comparable values of 17.5 lbs exertion force to obtain a 10% stretch and 1835 lbs of force are required to break the rectangle band at 10% stretch, as calculated and displayed in FIG. 14G.

Figures 15C, 15D:
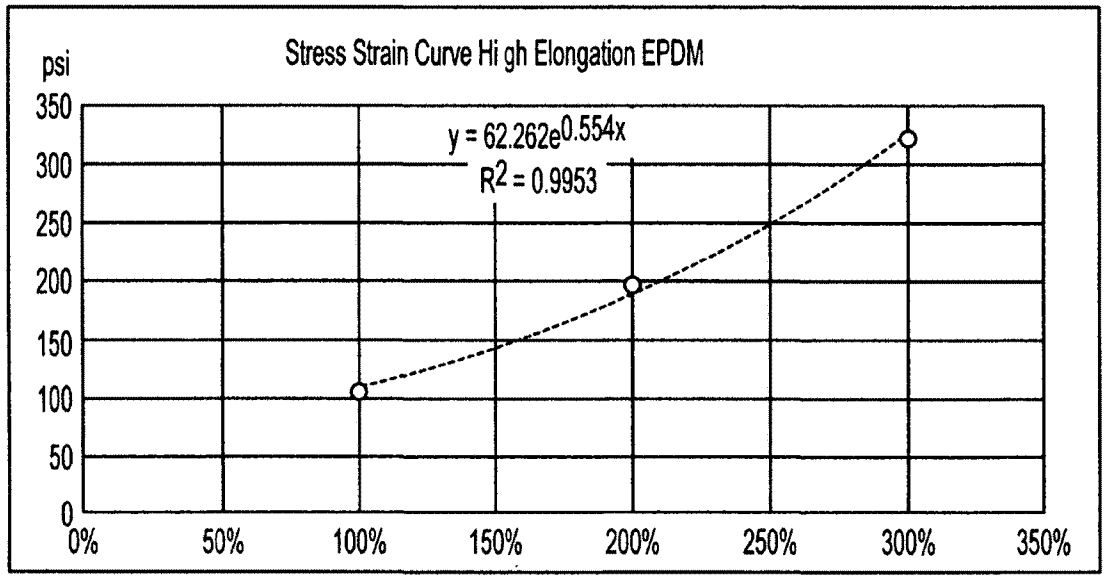

Referring to FIG. 15A, FIG. 15B, FIG. 15C, and FIG. 15D, force calculations for High Elongation EPDM Rubber Compounds for a black rubber tube and a black rubber rectangular band are presented in several views of a spreadsheet. In particular, FIG. 15D illustrates a stress strain curve chart with tensile strength values in psi on the Y axis of the chart for the High Elongation EPDM sample rubber compounds. Properties of Compounds are based on a band recipe formulary having a tensile strength of 2033 psi, as tested by ARDL. As described in FIG. 15A, at 10% stretch of the High Elongation EPDM Rubber black tube exercise band, the force exerted by the user to stretch the tube by 10% is 12.1 lbs; and, it is noteworthy that the pounds force it will take to break this exercise band will be 374.2 lbs. This particular compound will be somewhat difficult to break while a user is performing exercises.

Referring to FIG. 15E, FIG. 15F, and FIG. 15G, force calculations for EPDM Rubber Compounds for a black rubber tube and a black rubber rectangular band are presented in several views of a spreadsheet. In particular, FIG. 15G illustrates a stress strain curve graph with tensile strength values in psi on the Y axis of the graph for the EPDM sample rubber compounds. Properties of Compounds are based on a band recipe formulary having a tensile strength of 2300 psi, as tested by ARDL. As described in FIG. 15E, at 10% stretch of the EPDM Rubber black tube exercise band, the force exerted by the user to stretch the tube by 10% is 24.7 lbs; and, it is noteworthy that the pounds force it will take to break this exercise band will be 423.4 lbs. This particular compound will be somewhat difficult to break while a user is performing exercises.

Figure 16D:
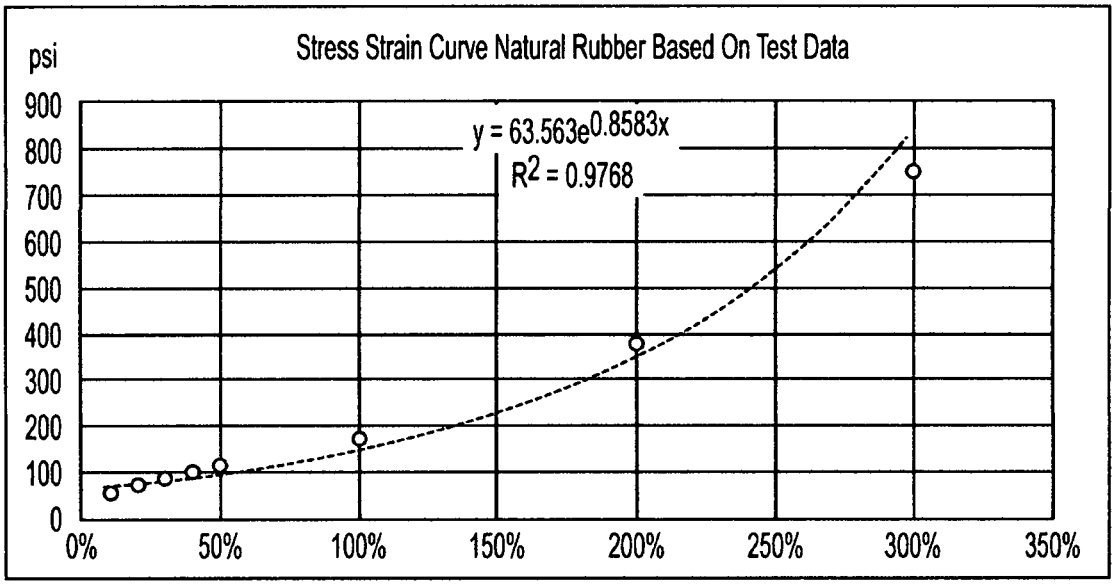

Referring to FIG. 16A, FIG. 16B, FIG. 16C, and FIG. 16D, force calculations for Natural Rubber Compounds for a Natural Rubber black hollow tube and Natural Rubber black solid rectangular band are presented in several views of a spreadsheet. In particular, FIG. 16D illustrates a stress strain curve graph with tensile strength values measured in psi on the Y axis of the graph, for the sample Natural Compounds. Properties of a proprietary recipe are represented by #6 as shown in the second column of FIG. 16A, FIG. 16B, and FIG. 16C. The recipe represented by #6 contains chemical ingredients which will cause the natural rubber exercise band to not form bloom, to not be susceptible to abrasions, to cause the rubber not be prone to cracks and to be resistant to oil, or other environmental conditions.

Referring to FIG. 16A force exerted by an exercise band user (equivalent to a 10 lbs weight) is calculated for a 10% stretch of the band by multiplying the 69.3 psi value (at col. 9, line 2) by the cross sectional area in square inches of 0.147 (at col. 5, line 6), which equals 10.2 lbs of force, for the tensile strength value of 3905 psi.

Again referring to FIG. 16A, FIG. 16B and FIG. 16D, Pound Force values for the Natural Rubber Compound can be determined with similar calculations for stretches of 20%, 30%, 40%, 50%, 60%, 70%, 80%, 90%, 100%, 110%, 120%, 130%, 140%, 150%, 160%, 170%, 180%, 190%, 200%, ad infinitum. Thus at 100% stretch of the band the force in pounds is calculated to be 150×0.147=22.08 lbs, where the value 150 is derived from the formula $y=63.56e^{0.858x}$ from the graph in FIG. 16D; and where 0.147 is the cross sectional area in square inches.

In the Black Tube sample discussed in FIG. 16B, when the tube outside diameter is 0.5 inch with a wall thickness of 0.250 inches, the cross sectional area is Area=$\pi r^2$; which equals 0.147 providing Pounds-force of 22.08 lbs, at 100% stretch. Also, that area equals the outer area minus the inner area (0.196−0.049=0.147). Also, based on the variations of the properties in any given compound, the variation in the value of the Pounds-Force can range from about ±5% up to about ±10%; therefore, Pounds-Force of 22.08 lbs, can vary from about 20.08 lbs up to about 24.28 lbs. However, a distinguishing feature in the best mode description of the preferred embodiment is the ability to precisely measure in real-time, the exact force in pounds, while performing any given resistance exercise with the OneBand continuous loop (300) exercise system, at any percentage stretch, using an integrated electronic digital scale (30*scl*).

Figure 17A:
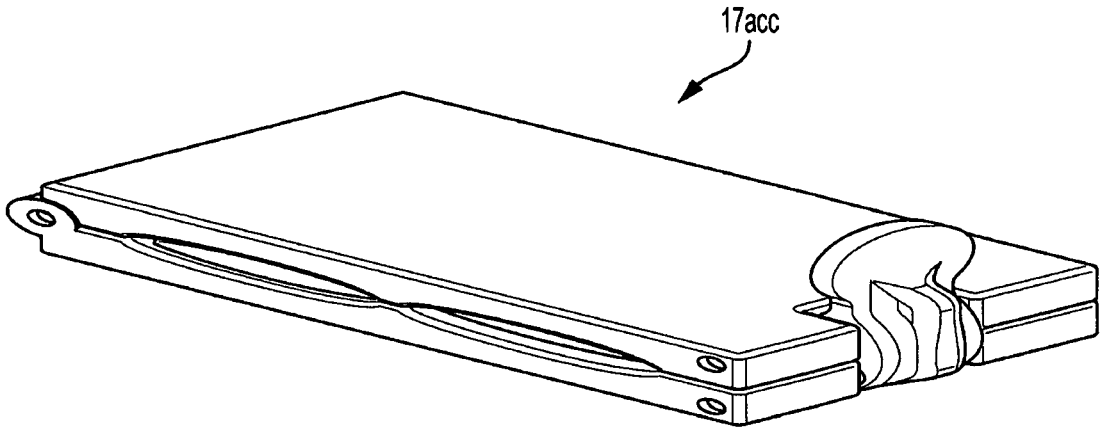
FIG. 17A and FIG. 17B illustrate views of an adjustable clamshell clamp (17*acc*) in open and closed positions, respectively. The adjustable clamshell clamp (17*acc*) clamps around either the elastic, flexible stretchable tube or the elastic, flexible stretchable band to provide the various sections in the continuous loop exercise system, in a manner similar to the adjustable-locking-release mechanism illustrated in FIG. 10A.
Figure 17B:
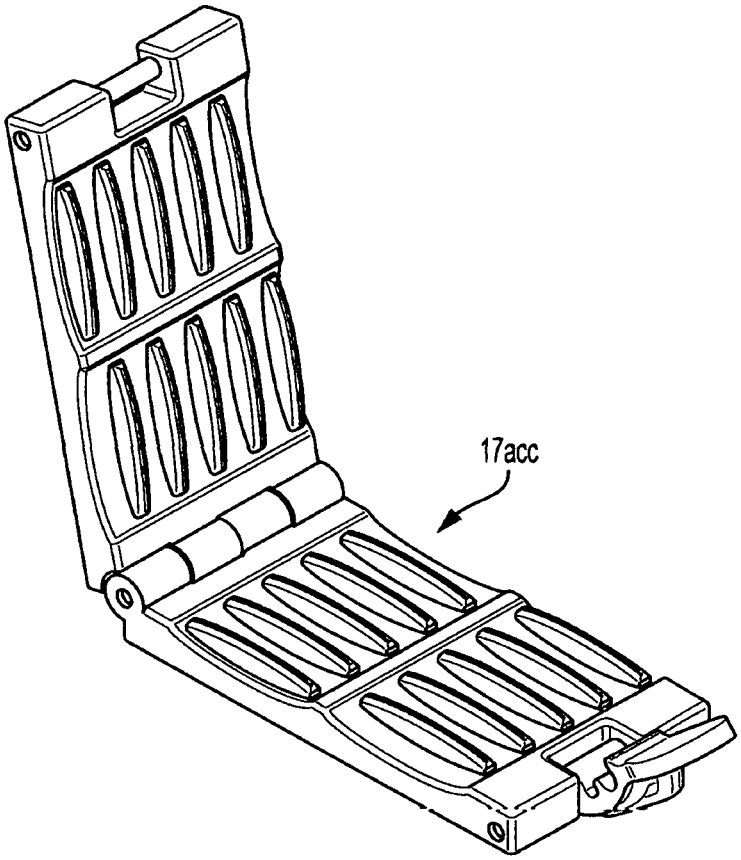

Referring to FIG. 17A and FIG. 17B, views of an adjustable clamshell clamp (17*acc*) in open and closed positions are shown, respectively. The adjustable clamshell clamp (17*acc*) clamps around either the elastic, flexible stretchable tube or the elastic, flexible stretchable band to provide the various sections in the continuous loop exercise system, in a manner similar to the adjustable-locking-release mechanism illustrated in FIG. 10A.

Figure 18:
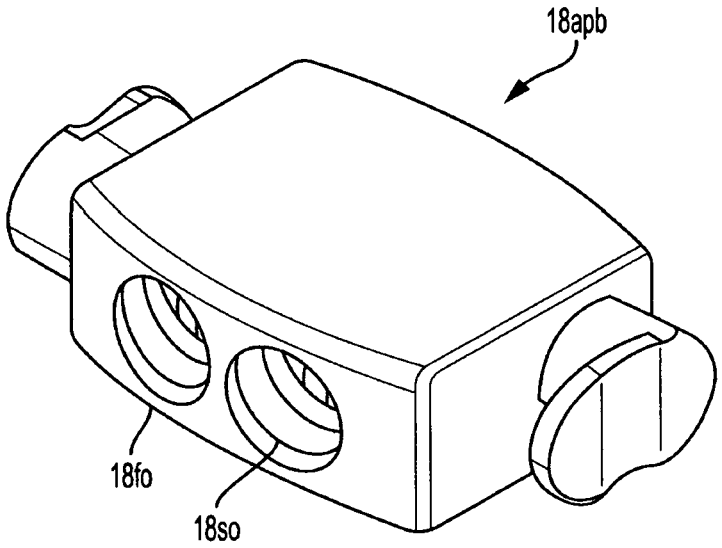
FIG. 18 illustrates an adjustable push button (18*apb*) mechanism, having a first opening (18*fo*) and having a second opening (18*so*), through which the length of elastic flexible tubing (20*etf*) folded into the form of a section (4S3) and both ends of the elastic flexible tubing (20*etf*) threaded through the opening of the adjustable push button (18*apb*) mechanism and can be used as a handle for the exercise user to hold onto, while performing exercises with the continuous loop exercise system in a manner similar to the adjustable-locking-release (10*alr*) mechanism illustrated in FIG. 10A.

Referring to FIG. 18, an adjustable push button (18*apb*) mechanism, having a first opening (18*fo*) and having a second opening (18*so*), through which the length of elastic flexible tubing (20*etf*) folded into the form of a section (4S3) and both ends of the elastic flexible tubing (20*etf*) threaded through the opening of the adjustable push button (18*apb*) mechanism and can be used as a handle for the exercise user to hold onto, while performing exercises with the continuous loop exercise system in a manner similar to the adjustable-locking-release (10*alr*) mechanism illustrated in FIG. 10A.

While the disclosure has been described with reference to exemplary embodiments, it will be understood by those skilled in the art that various changes can optionally be made and equivalents can be substituted for elements thereof without departing from the scope of the disclosure. In addition, many modifications can be made to adapt a particular situation or material to the teachings of the disclosure without departing from the essential scope thereof. Therefore, it is intended that the disclosure not be limited to the particular exemplary embodiment or embodiments disclosed herein as the best mode contemplated for carrying out this disclosure, but that the disclosure will include all embodiments falling within the scope of the appended claims.

What is claimed is:

1. A process of producing a continuous loop, elastic, flexible, stretchable and calibrated exercise apparatus comprising:

compounding one of band and tube properties from a plurality of formulary recipes to produce one of an elastic, flexible, stretchable, tube and an elastic, flexible, stretchable, band, wherein the elastic, flexible, stretchable, tube and the elastic, flexible, stretchable, band, each having a first end and a second end, are 83 inches in length un-stretched, wherein the elastic, flexible, stretchable tube further comprising an outer wall and an inner wall having a thickness between the outer wall and the inner wall, providing an internal cavity in the elastic, flexible, stretchable, tube having an inner diameter and an outer diameter, wherein the elastic, flexible, stretchable, band further comprising a solid rectangular shape having four sides and a solid inner rectangular area, wherein one of the elastic, flexible, stretchable, tube and the elastic, flexible, stretchable, band is folded in half forming a first loop, having one of the first end and the second end of one of the elastic, flexible, stretchable, tube and the elastic, flexible, stretchable, band positioned side by side;

molding a plurality of three-layered, easily-releasable, spring-pressured adjustable-locking-release mechanisms having designed modifiable spring pressure interfacing;

threading one of a first three-layered, easily-releasable, spring-pressured adjustable-locking-release mechanism with ends of one of the elastic, flexible, stretchable, tube, and the elastic, flexible, stretchable band such that the first end and the second end of one of the elastic flexible, stretchable, tube and the elastic, flexible, stretchable band inserted into a first opening and a second opening in the first three-layered, easily-releasable, spring-pressured adjustable-locking-release mechanism, wherein the first three-layered, easily-releasable, spring-pressured adjustable-locking-release mechanism is positioned and locked in position at a first position at the first distance of 12 inches from the first loop, wherein the first end and the second end of one of the elastic flexible, stretchable, tube and the elastic, flexible, stretchable band are inserted into a first opening and a second opening in a second three-layered, easily-releasable, spring-pressured adjustable-locking-release mechanism; wherein the second three-layered, easily-releasable, spring-pressured adjustable-locking-release mechanism is positioned and locked in position at a second position at a second distance of 12 inches from the first three-layered, easily-releasable, spring-pressured adjustable-locking-release mechanism, wherein one of a first knot is tied with the first end and the second end, leaving 3 cm length of the first end and the second end of one of the elastic, flexible, stretchable tube and the elastic, flexible, stretchable band extending;

attaching an electronic digital scale removably attached to the first loop of the first 12 inch section of one of the elastic, flexible, stretchable, tube and the elastic, flexible, stretchable band; wherein the electronic digital scale displays on a digital display screen the lbs force an exercise user exerts when stretching the one of the elastic, flexible, stretchable tube, and the elastic, flexible, stretchable band wherein the electronic digital scale and the three-layered, easily-releasable, spring-pressured adjustable-locking-release mechanisms are configured as handles, producing the continuous loop, elastic, flexible, stretchable and calibrated exercise apparatus, used by the exercise user to grasp the handles while performing exercises using the continuous loop, elastic, flexible, stretchable, calibrated exercise apparatus, and wherein the one of the elastic, flexible, stretchable, tube and the elastic, flexible, stretchable band is stretchable in a range from about 1% stretch up to about 300% stretch; and wherein the one of the elastic, flexible, stretchable, tube and the elastic, flexible, stretchable band is calibrated by releasably and slidably positioning at least one of the three-layered easily-releasable, spring-pressured adjustable-locking-releasable mechanisms along the one of the elastic, flexible, stretchable, tube and the elastic, flexible, stretchable, band and wherein said electronic digital scale is removably attached to said first loop of said first 12 inch section of the one of the elastic, flexible, stretchable, tube and the elastic, flexible, stretchable band using connectors including one of loops, buckles, rings, handles, snaps, straps and a strap.

2. The process of producing the continuous loop, elastic, flexible, stretchable and calibrated exercise apparatus, according to claim 1, further comprising:

compounding one of a natural rubber compound, and an EPDM (Ethylene Propylene Diene Monomer) compound, wherein the natural rubber compound and the EPDM compound having compound formulas which inhibit abrasions, and inhibit bloom, and further having compound formulas which inhibit cracks, and further having compound formulas which facilitate resistance to oil contamination and resistance to environmental contamination, wherein the EPDM rubber compound is a high elongation EPDM rubber compound, and wherein the natural rubber compound is a latex dipped natural rubber compound.

3. The process of producing the continuous loop, elastic, flexible, stretchable and calibrated exercise apparatus, according to claim 1, further comprising:

compounding, from the plurality of formulary recipes for the one of the elastic, flexible, stretchable tube properties and the elastic, flexible, stretchable band properties, a tensile strength in a range from about 600 psi up to about 6000 psi.

4. The process of producing the continuous loop, elastic, flexible, stretchable and calibrated exercise apparatus, according to claim 3, further comprising:

a tube tensile strength of one of 4894 psi, 3905 psi, 2300 psi, and 2033 psi, wherein, the elastic, flexible, stretchable, tube having one of a pounds force value of ±9.0 lbs ±10.2 lbs ±24.7 lbs and ±12.1 lbs respectively, at 10% stretch of the elastic, flexible, stretchable, tube.

5. The process of producing the continuous loop, elastic, flexible, stretchable and calibrated exercise apparatus, according to claim 3, further comprising:

a band tensile strength of one of 4894 psi, 3905 psi, and 2300 psi, wherein, the elastic, flexible, stretchable, band having one of a pounds force value of ±17.5 lbs ±25.97 lbs and ±25.2 lbs respectively at 10% stretch of the elastic, flexible, stretchable, band.

6. A continuous loop, elastic, flexible, stretchable and calibrated exercise apparatus comprising:

an elastic, flexible, stretchable tube, wherein the elastic, flexible, stretchable, tube having a first end and a second end, is 83 inches in length un-stretched, wherein the elastic, flexible, stretchable tube further comprising an outer wall and an inner wall having a thickness between the outer wall and the inner wall, providing an internal cavity in the elastic, flexible, stretchable, tube having an inner diameter and an outer diameter, wherein the elastic, flexible, stretchable, tube is folded in half forming a first loop, having one of the first end and the second end of the elastic, flexible, stretchable, tube and positioned side by side; wherein at a first distance of 12 inches from the first loop, a first three-layered, easily-releasable, spring-pressured adjustable-locking-release mechanism receives both ends of the elastic, flexible, stretchable, tube, such that the first end and the second end of the elastic flexible, stretchable, tube inserted into a first opening and a second opening in the first three-layered, easily-releasable, spring-pressured adjustable-locking-release mechanism and the first three-layered, easily-releasable, spring-pressured adjustable-locking-release mechanism is positioned and locked in position at a first position at the first distance of 12 inches from the first loop, wherein the first end and the second end of the elastic flexible, stretchable, tube inserted into a first opening and a second opening in a second three-layered, easily-releasable, spring-pressured adjustable-locking-release mechanism and the second three-layered, easily-releasable, spring-pressured adjustable-locking-release mechanism is positioned and locked in position at a second position at a second distance of 12 inches from the first three-layered, easily-releasable, spring-pressured adjustable-locking-release mechanism, wherein one of a first knot is tied with the first end and the second end, leaving 3 cm length of the first end and the second end of the elastic, flexible, stretchable tube extending, forming a continuous loop, elastic, flexible, stretchable exercise apparatus; wherein, the first three-layered, easily-releasable, spring-pressured adjustable-locking-release mechanism, and the second three-layered, easily-releasable, spring-pressures adjustable-locking-release mechanism all have a spring actuated push button pressably connected to the elastic, flexible stretchable tube inserted; wherein when the spring actuated push button is actuated by an exercise user, pressure adjustment on the elastic, flexible, stretchable tube, selected from the group of pressure adjustments consisting essentially of releasing pressure and increasing pressure is exerted by the exercise user to facilitate calibrating the continuous loop, elastic, flexible, stretchable and calibrated exercise apparatus; wherein the elastic, flexible, stretchable, tube further comprising: an electronic digital scale removably attached to the first loop of the first 12 inch section of the elastic, flexible, stretchable, tube, wherein the electronic digital scale displays on a digital display screen the lbs force an exercise user exerts when stretching the elastic, flexible, stretchable tube, and wherein the electronic digital scale and the three-layered, easily-releasable, spring-pressured adjustable-locking releasable mechanisms are configured as handles, used by the exercise user to grasp the handles while performing exercises using the continuous loop, elastic, flexible, stretchable, calibrated exercise apparatus, and wherein the elastic, flexible, stretchable, tube is stretchable in a range from about 1% stretch up to about 300% stretch, and wherein the elastic, flexible, stretchable, tube is calibrated by releasably and slidably positioning at least one of the three-layered easily-releasable, spring-pressured adjustable-locking-releasable mechanisms along the elastic, flexible, stretchable, tube and wherein said electronic digital scale is removably attached to said first loop of said first 12 inch section of said elastic, flexible, stretchable, tube using connectors including one of loops, buckles, rings, clamps, handles, snaps, straps and a strap.

7. The continuous loop, elastic, flexible, stretchable and calibrated exercise apparatus, according to claim 6, wherein the elastic, flexible, stretchable, tube further comprising:

one of a natural rubber compound, and an EPDM (Ethylene Propylene Diene Monomer) rubber compound, wherein the EPDM rubber compound is a high elongation EPDM rubber compound, and wherein the natural rubber compound is a latex dipped natural rubber compound.

8. The continuous loop, elastic, flexible, stretchable and calibrated exercise apparatus, according to claim 6, wherein the elastic, flexible, stretchable, tube further comprising:

a tensile strength in a range from about 600 psi up to about 6000 psi, and the adjustable-locking-release mechanism is composed of one of rubber and plastic.

9. The continuous loop, elastic, flexible, stretchable and calibrated exercise apparatus, according to claim 8, wherein the elastic, flexible, stretchable, tube further comprising:

a tensile strength of one of 4894 psi, and 3905 psi, wherein, the elastic, flexible, stretchable, tube having one of a pounds force value of ±20.9 lbs and ±22.08 lbs respectively, at 100% stretch of the elastic, flexible, stretchable, tube.

10. A continuous loop, elastic, flexible, stretchable and calibrated exercise apparatus comprising:

an elastic, flexible, stretchable band, wherein the elastic, flexible, stretchable, band having a first end and a second end, is 83 inches in length un-stretched, wherein the elastic, flexible, stretchable, band further comprising a solid rectangular shape having four sides and a solid inner rectangular area, wherein the elastic, flexible, stretchable, band is folded in half forming a first loop, having one of the first end and the second end of the elastic, flexible, stretchable, band positioned side by side; wherein at a first distance of 12 inches from the first loop, a first three-layered, easily-releasable, spring-pressured adjustable-locking-release mechanism receives both ends of the elastic, flexible, stretchable, band, such that the first end and the second end of the elastic flexible, stretchable, band inserted into a first opening and a second opening in the first three-layered, easily-releasable, spring-pressured adjustable-locking-release mechanism and the first three-layered, easily-releasable, spring-pressured adjustable-locking-release mechanism is positioned and locked in position at a first position at the first distance of 12 inches from the first loop, wherein the first end and the second end of the elastic flexible, stretchable, band inserted into a first opening and a second opening in a second three-layered, easily-releasable, spring-pressured adjustable-locking-release mechanism and the second three-layered, easily-releasable, spring-pressured adjustable-locking-release mechanism is positioned and locked in position at a second position at a second distance of 12 inches from the first three-layered, easily-releasable, spring-pressured adjustable-locking-release mechanism, wherein one of a first knot is tied with the first end and the second end, leaving 3 cm length of the first end and the second end of the elastic, flexible, stretchable band extending, forming a continuous loop, elastic, flexible, stretchable and calibrated exercise apparatus; wherein, the first three-layered, easily-releasable, spring-pressured adjustable-locking-release mechanism, and the second three-layered, easily-releasable, spring-pressures adjustable-locking-release mechanism all have a spring actuated push button pressably connected to the elastic, flexible stretchable band inserted; wherein when the spring actuated push button is actuated by an exercise user, pressure adjustment on the elastic, flexible, stretchable band, selected from the group of pressure adjustments consisting of releasing pressure and increasing pressure is exerted by the exercise user to facilitate calibrating the continuous loop, elastic, flexible, stretchable and calibrated exercise apparatus; wherein the elastic, flexible, stretchable, band further comprising: an electronic digital scale removably attached to the first loop of the first 12 inch section of the elastic, flexible, stretchable, band, wherein the electronic digital scale displays on a digital display screen the lbs force an exercise user exerts when stretching the elastic, flexible, stretchable band, and wherein the electronic digital scale and the three-layered, easily-releasable, spring-pressured adjustable-locking-releasable mechanisms are configured as handles, used by the exercise user to grasp the handles while performing exercises using the continuous loop, elastic, flexible, stretchable, and calibrated exercise apparatus, and wherein the elastic, flexible, stretchable, band is stretchable in a range from about 1% stretch up to about 300% stretch, and wherein the elastic, flexible, stretchable, band is calibrated by releasably and slidably positioning at least one of the three-layered easily-releasable, spring-pressured adjustable-locking-releasable mechanisms along the elastic, flexible, stretchable, band and wherein said electronic digital scale is removably attached to said first loop of said first 12 inch section of said elastic, flexible, stretchable, band using connectors including one of loops, buckles, rings, clamps, handles, snaps, straps and a strap.

11. The continuous loop, elastic, flexible, stretchable and calibrated exercise apparatus, according to claim 10, wherein the elastic, flexible, stretchable, band further comprising:

one of a natural rubber compound, and an EPDM (Ethylene Propylene Diene Monomer) rubber compound, wherein the EPDM rubber compound is a high elongation EPDM rubber compound, and wherein the natural rubber compound is a latex dipped natural rubber compound.

12. The continuous loop, elastic, flexible, stretchable and calibrated exercise apparatus, according to claim 10, wherein the elastic, flexible, stretchable, band further comprising:

a tensile strength in a range from about 600 psi up to about 6000 psi, and the first three-layered easily-releasable, spring-pressured adjustable-locking-releasable mechanism and the second three-layered easily-releasable, spring-pressured adjustable locking-releasable mechanism are composed of one of rubber and plastic.

13. The continuous loop, elastic, flexible, stretchable and calibrated exercise apparatus, according to claim 12, wherein the elastic, flexible, stretchable, band further comprising:

a tensile strength of one of 4894 psi, and 3905 psi, wherein, the elastic, flexible, stretchable, band having one of a pounds force value of ±40.5 lbs and ±56.23, lbs respectively, at 100% stretch of the elastic, flexible, stretchable, band.

* * * * *